US006921314B2

(12) United States Patent
Miller

(10) Patent No.: US 6,921,314 B2
(45) **Date of Patent: *Jul. 26, 2005**

(54) INTERCLEAVING SPATIALLY DICHOTOMIZED POLYHEDRAL BUILDING BLOCKS AND EXTENSIONS

(76) Inventor: George R. Miller, 11630 Southern Maryland Blvd., Dunkirk, MD (US) 20754

( * ) Notice: Subject to any disclaimer, the term of this patent is extended or adjusted under 35 U.S.C. 154(b) by 181 days.

This patent is subject to a terminal disclaimer.

(21) Appl. No.: 10/046,118

(22) Filed: Jan. 15, 2002

(65) Prior Publication Data

US 2002/0058456 A1 May 16, 2002

Related U.S. Application Data

(63) Continuation-in-part of application No. 09/266,010, filed on Mar. 11, 1999.

(60) Provisional application No. 60/077,908, filed on Mar. 13, 1998, provisional application No. 60/092,842, filed on Jul. 14, 1998, and provisional application No. 60/318,828, filed on Sep. 14, 2001.

(51) Int. Cl.[7] ..... A63H 33/04

(52) U.S. Cl. ..... 446/85; 446/487

(58) Field of Search ..... 446/85, 101, 124, 446/125, 126, 108, 487, 116

(56) References Cited

U.S. PATENT DOCUMENTS

| | | | |
|---|---|---|---|
| 589,708 | A | 9/1897 | Flint |
| 1,818,261 | A | 8/1931 | Koch et al. |
| 2,151,066 | A | 3/1939 | Anderson |
| 2,441,921 | A | 5/1948 | Reynolds |
| 2,549,189 | A | 4/1951 | Gabo |
| 2,607,311 | A | 8/1952 | Doan |
| 2,633,662 | A | 4/1953 | Nelson |

(Continued)

FOREIGN PATENT DOCUMENTS

| | | | | |
|---|---|---|---|---|
| CH | 245402 | | 7/1946 | |
| CH | 266913 | | 5/1970 | |
| DE | 3929190 | A1 * | 1/1990 | ..... A63F/9/12 |
| EP | 0379389 | | 7/1990 | |
| FR | 2646889 | A1 * | 11/1990 | ..... A63F/9/12 |

*Primary Examiner*—Derris H. Banks
*Assistant Examiner*—Urszula M Cegielnik

(57) ABSTRACT

The invention is a system and set of intercleaving (interfitting and adhering/clinging) toy or real polyhedral construction elements which may be implemented either directly in physical form or indirectly in a virtual reality via the hardware of a computer system. These construction elements may be used as structural elements, building blocks, modeling elements, or the like. Each element of the invention has the ability to be interfitted with other complimentary elements in a mutually intercleaving manner along the coincident edges (edgesets) of sets of edge-aligned diagonally adjacent pyramidal/polyhedral members which, while connected along an innermost portion of those edgesets for structural stability, have been separated/difurcated along an outermost portion of those same edgesets in order to facilitate, along with resulting pyramidal/polyhedral recesses, their interfitting. These generally polyhedral construction elements may also be projected into spherical/ellipsoidal forms while retaining the basic characteristics of their underlying polyhedron-based definitions.

53 Claims, 20 Drawing Sheets

U.S. PATENT DOCUMENTS

| | | | | | |
|---|---|---|---|---|---|
| 2,709,318 | A | | 5/1955 | Benjamin | |
| 2,848,769 | A | | 8/1958 | Oakley | |
| D213,709 | S | | 4/1969 | Gale | |
| 3,461,574 | A | | 8/1969 | Larsen et al. | |
| 3,510,962 | A | | 5/1970 | Sato | |
| 3,537,706 | A | | 11/1970 | Heavener, Jr. | |
| 3,545,123 | A | | 12/1970 | Muller | |
| 3,564,758 | A | | 2/1971 | Willis | |
| 3,568,381 | A | | 3/1971 | Hale | |
| 3,597,874 | A | | 8/1971 | Obsbury | |
| 3,726,027 | A | * | 4/1973 | Cohen et al. | 434/98 |
| 3,782,029 | A | | 1/1974 | Bardot | |
| 3,785,066 | A | | 1/1974 | Tuitt | |
| 3,800,556 | A | | 4/1974 | Duerkson | |
| 3,899,838 | A | * | 8/1975 | Lalley et al. | 434/189 |
| 3,950,888 | A | | 4/1976 | Hogan | |
| 3,970,301 | A | | 7/1976 | Lemann | |
| 4,026,087 | A | | 5/1977 | White | |
| 4,051,621 | A | | 10/1977 | Hogan | |
| 4,079,541 | A | | 3/1978 | Hogan | |
| 4,207,715 | A | | 6/1980 | Kitrick | |
| 4,271,628 | A | | 6/1981 | Barlow | |
| 4,334,871 | A | * | 6/1982 | Roane | 434/211 |
| 4,380,133 | A | * | 4/1983 | Arnstein | 446/488 |
| 4,676,507 | A | | 6/1987 | Patterson | |
| 4,719,726 | A | | 1/1988 | Bergman | |
| 5,046,988 | A | | 9/1991 | Bennett | |
| 5,448,868 | A | | 9/1995 | Lalvani | |
| 5,489,230 | A | * | 2/1996 | Gavula, Jr. | 446/109 |
| 5,553,967 | A | | 9/1996 | Uozumi | |
| 5,567,194 | A | | 10/1996 | Stapleton | |
| 5,593,337 | A | | 1/1997 | Lapointe | |
| 5,617,691 | A | | 4/1997 | Yamamoto | |
| 5,651,679 | A | * | 7/1997 | Altman | 434/211 |
| 5,906,530 | A | | 5/1999 | Lindsey | |
| 6,059,631 | A | | 5/2000 | Maddock | |
| 6,152,797 | A | | 11/2000 | David | |
| 6,231,416 | B1 | | 5/2001 | Clever et al. | |
| 6,379,212 | B1 | | 4/2002 | Miller | |

* cited by examiner

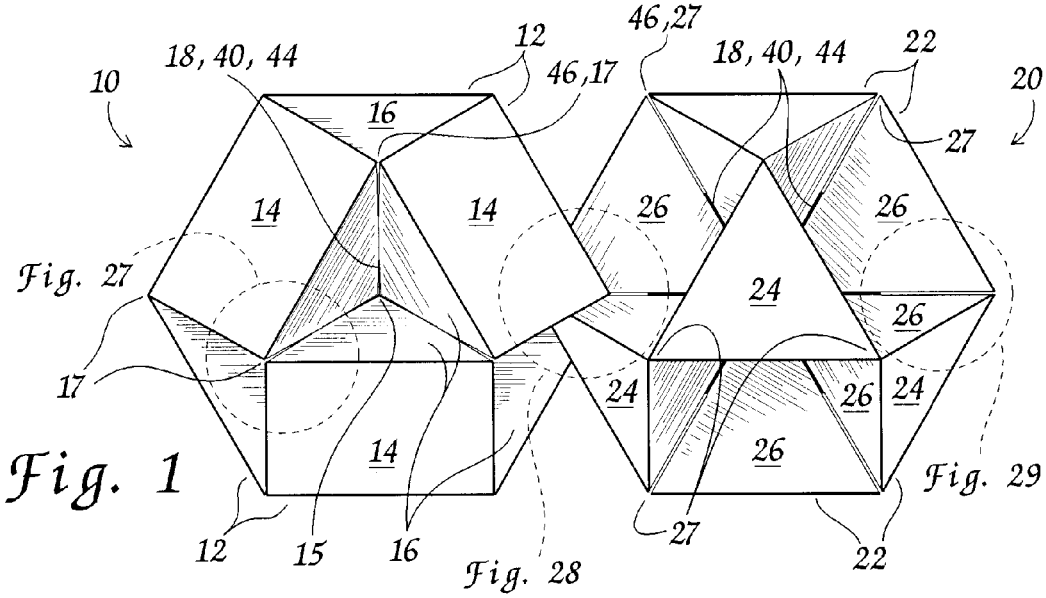
Fig. 1
Fig. 28
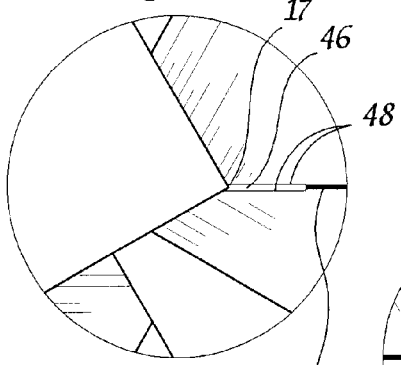
Fig. 27
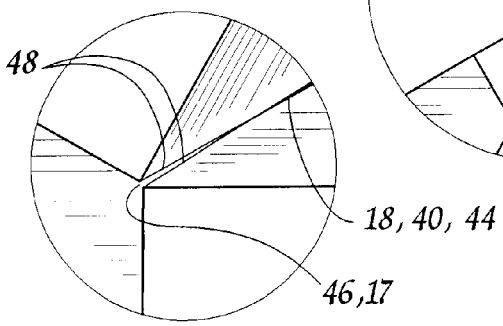
Fig. 29
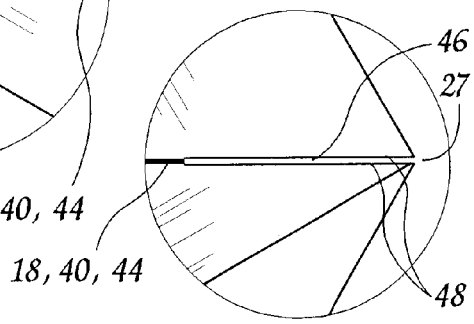

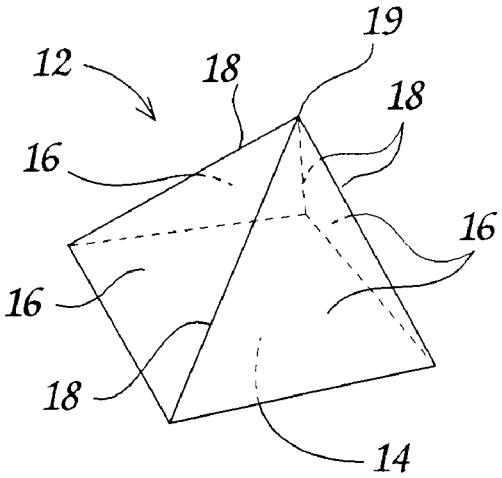
Fig. 2
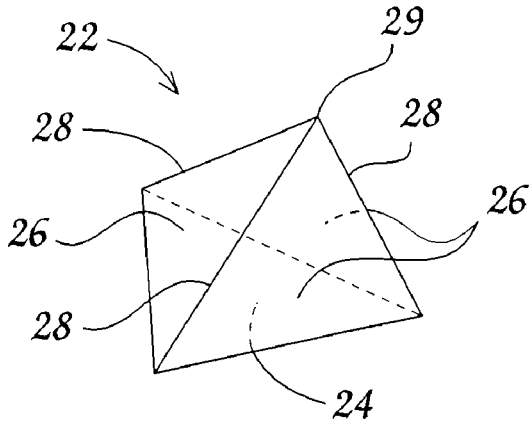
Fig. 3
Fig. 15a
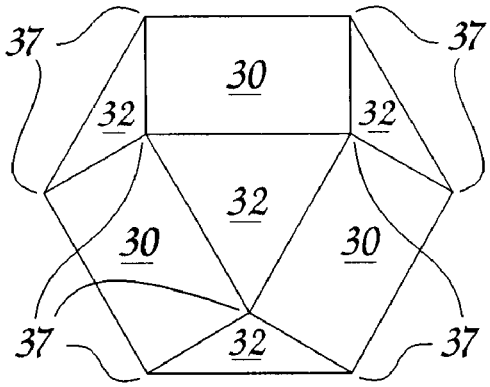
Fig. 15b
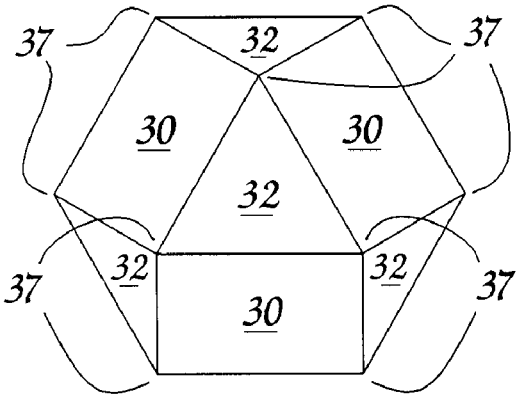

Fig. 30
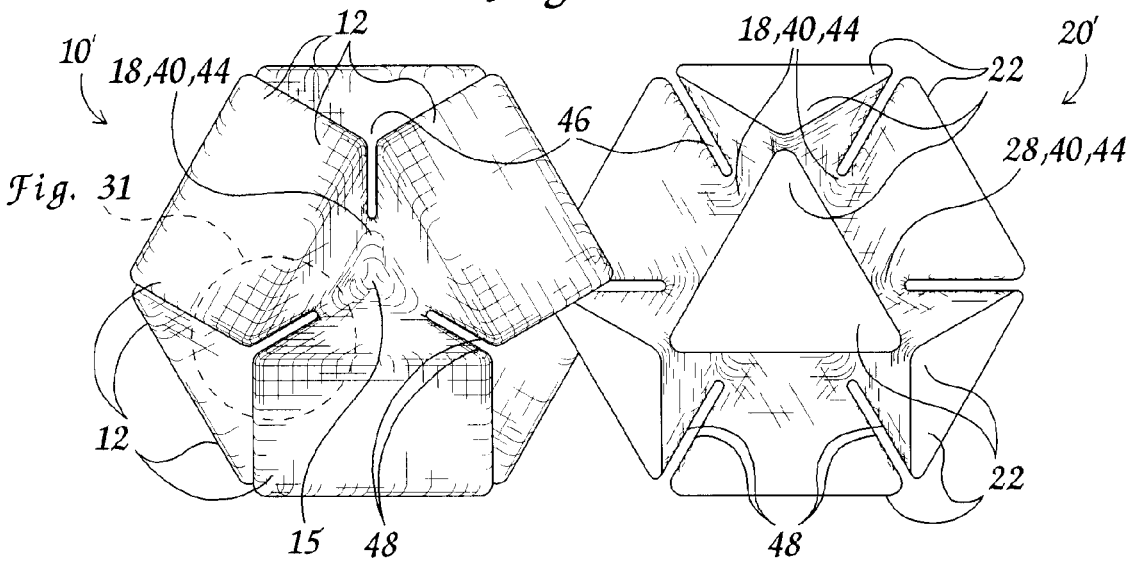
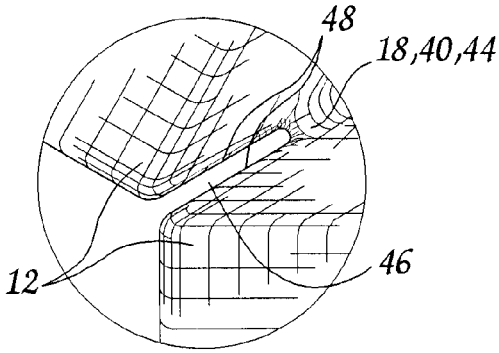
Fig. 31
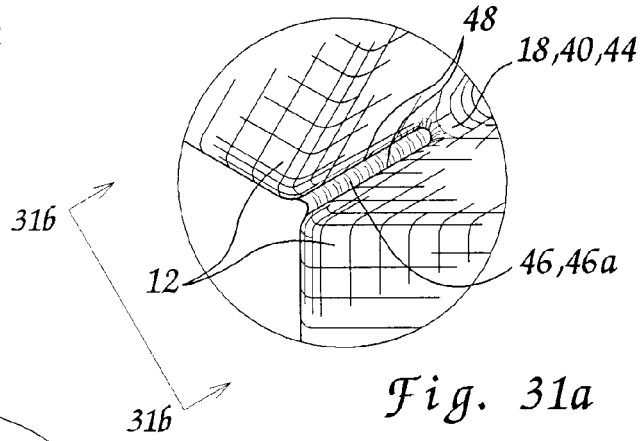
Fig. 31a
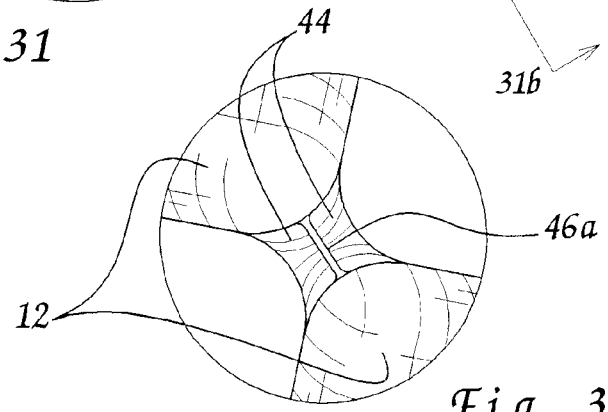
Fig. 31b

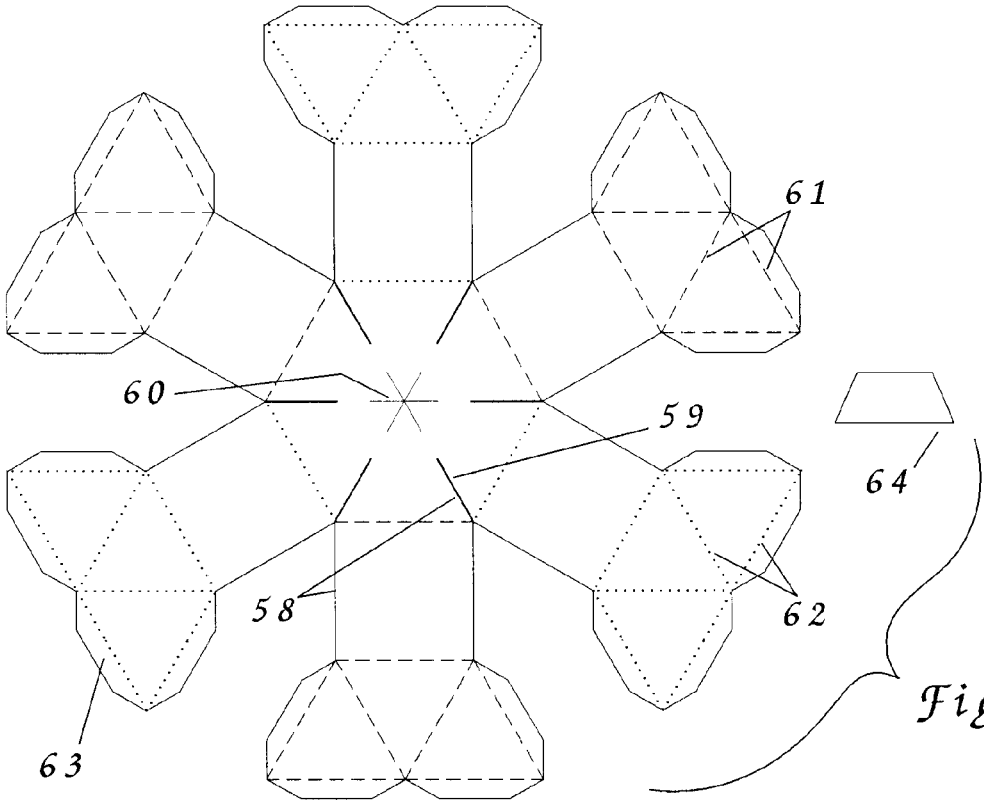
Fig. 35
Fig. 36
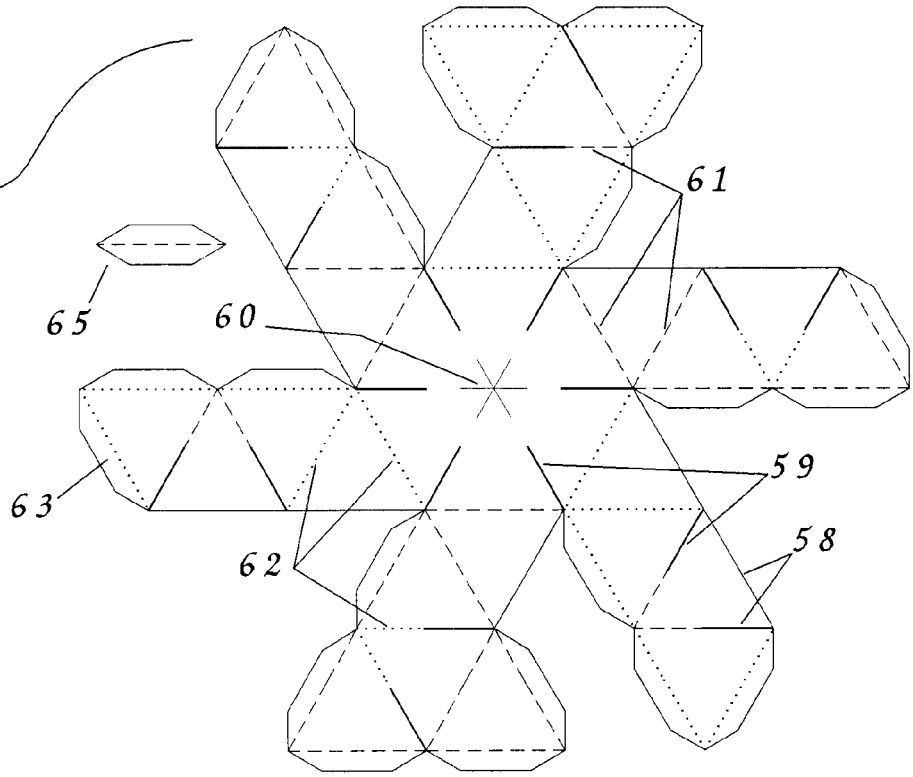

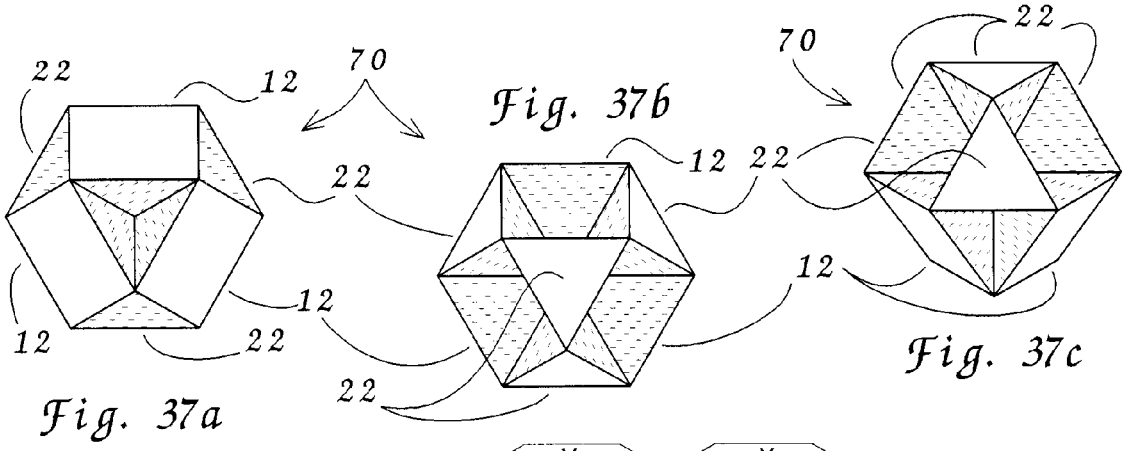
22
12
70
22
12
12
22
Fig. 37b
12
22
22
70
22
12
Fig. 37c
Fig. 37a
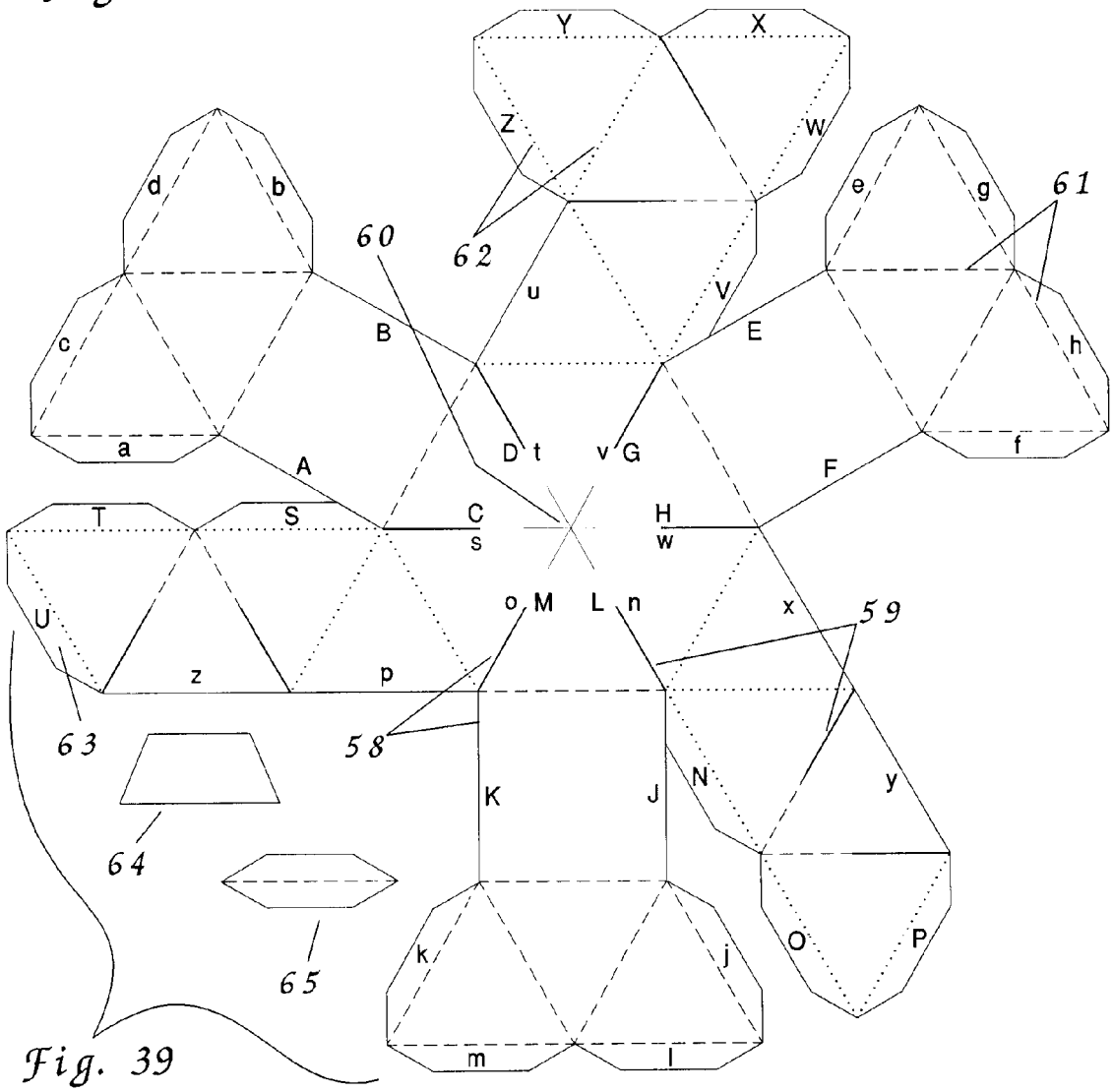
Y
X
Z
W
d
b
e
g
61
60
62
u
V
B
E
c
h
a
D
t
v
G
f
A
F
T
S
C
s
H
w
U
o
M
L
n
x
59
z
p
63
58
K
J
N
y
64
65
O
P
k
j
m
l
Fig. 39

Fig. 44
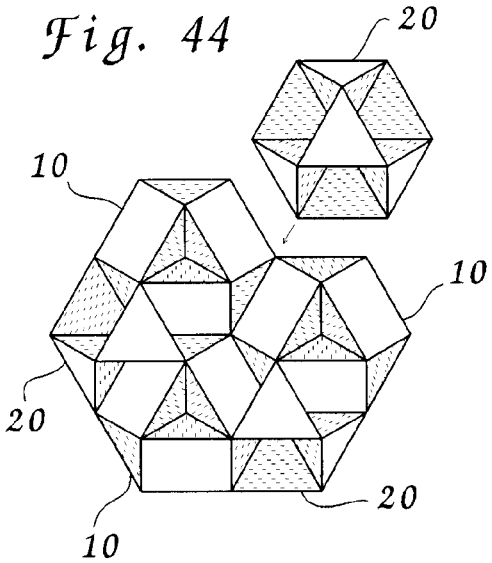
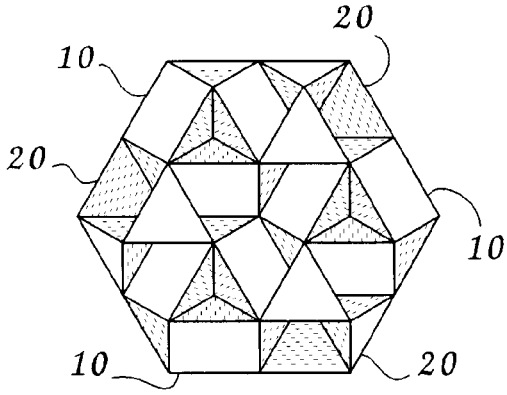
Fig. 45a
Fig. 45b
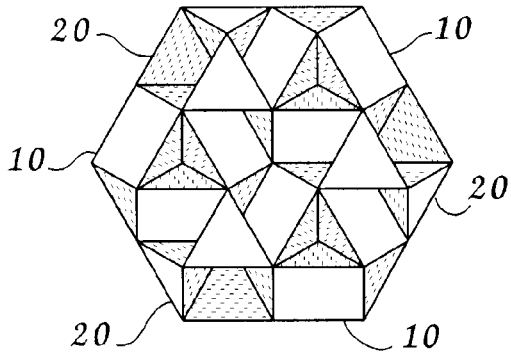
Fig. 46
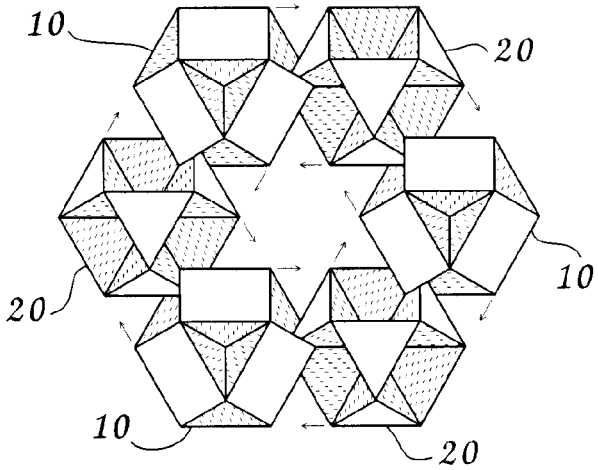
Fig. 47
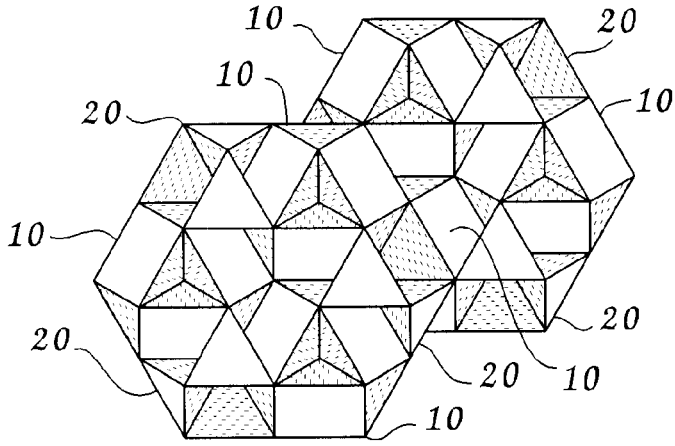

Fig. 54a
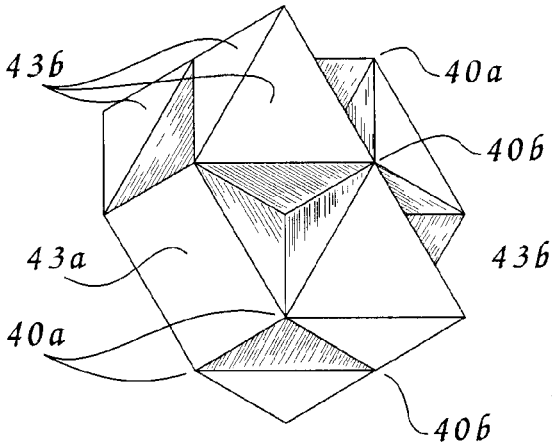
Fig. 54b
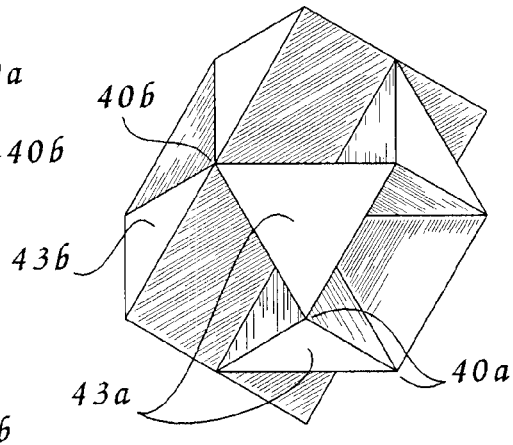
Fig. 56a
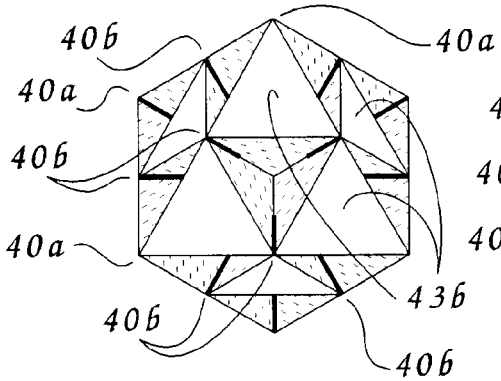
Fig. 56b
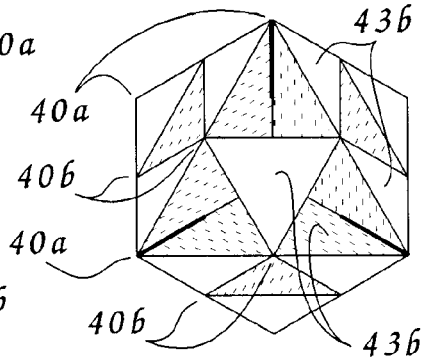
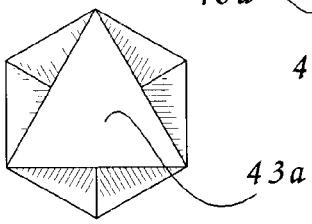
Fig. 55

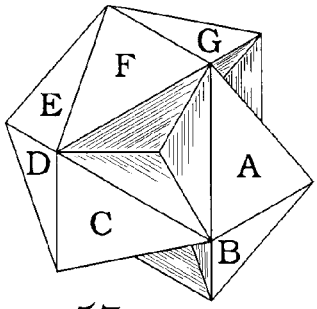
Fig. 57a
Fig. 57b
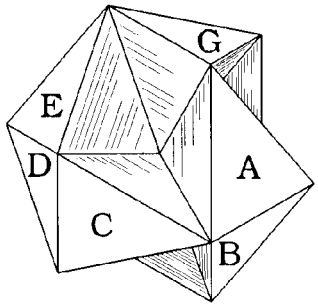
Fig. 57c
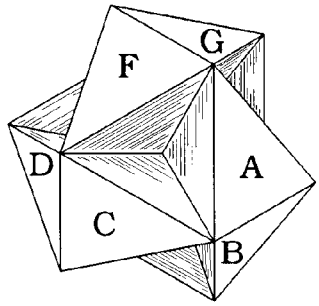
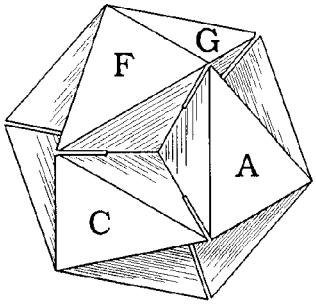
Fig. 57d
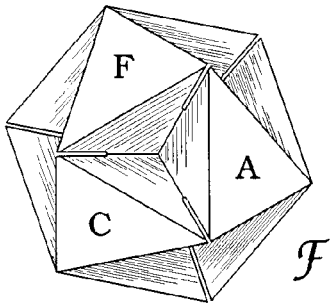
Fig. 57e
Fig. 58a
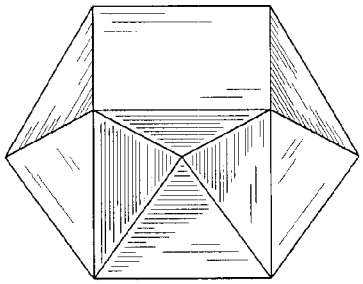
Fig. 58b
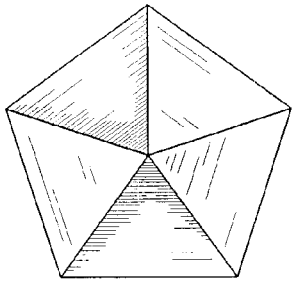
Fig. 58c
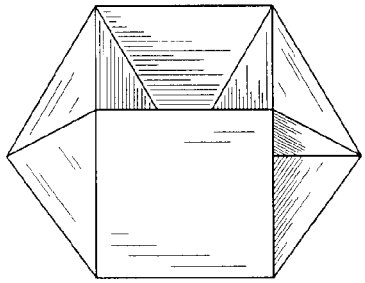

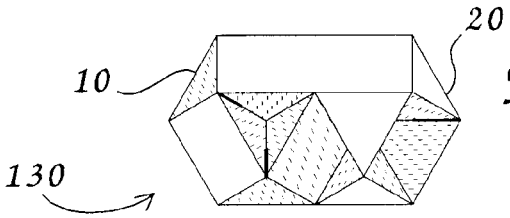
Fig. 63b
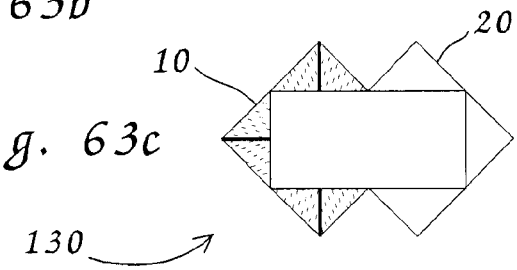
Fig. 63c
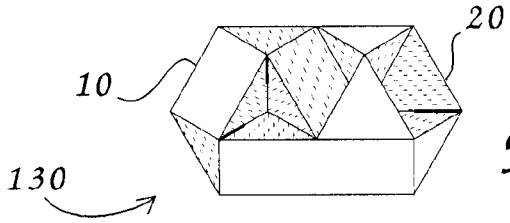
Fig. 63a
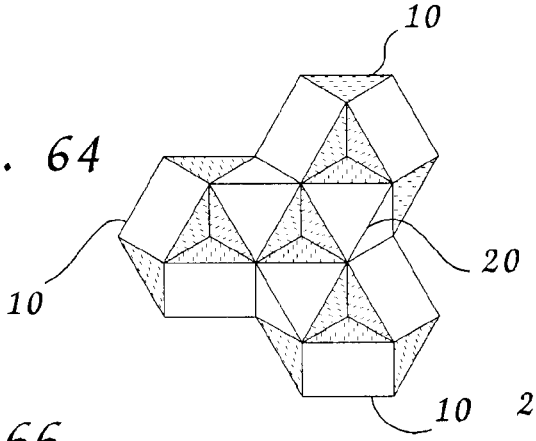
Fig. 64
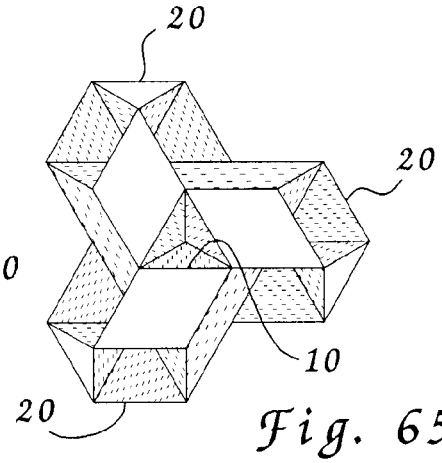
Fig. 65
Fig. 66
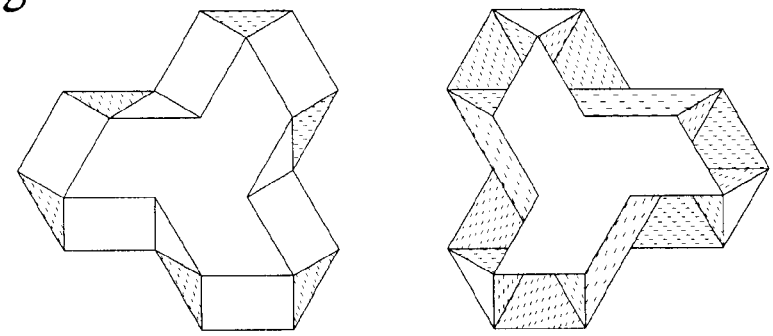
Fig. 67

Fig. 68
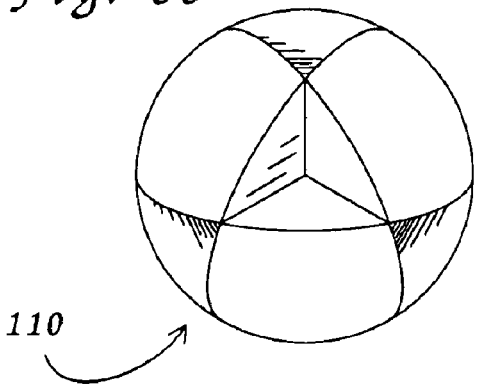
Fig. 69
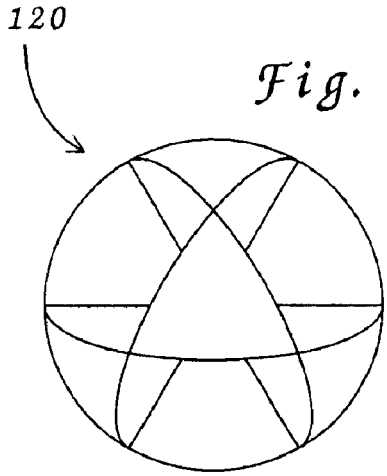
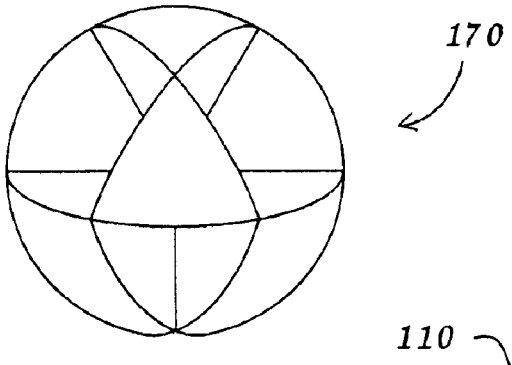
Fig. 70
Fig. 71
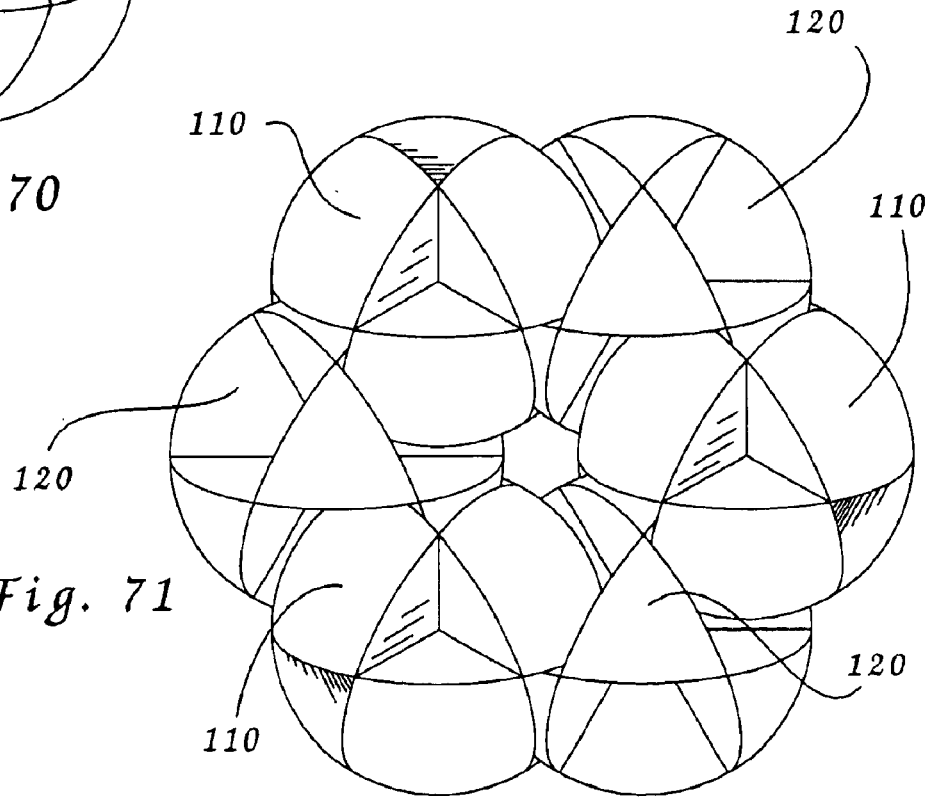

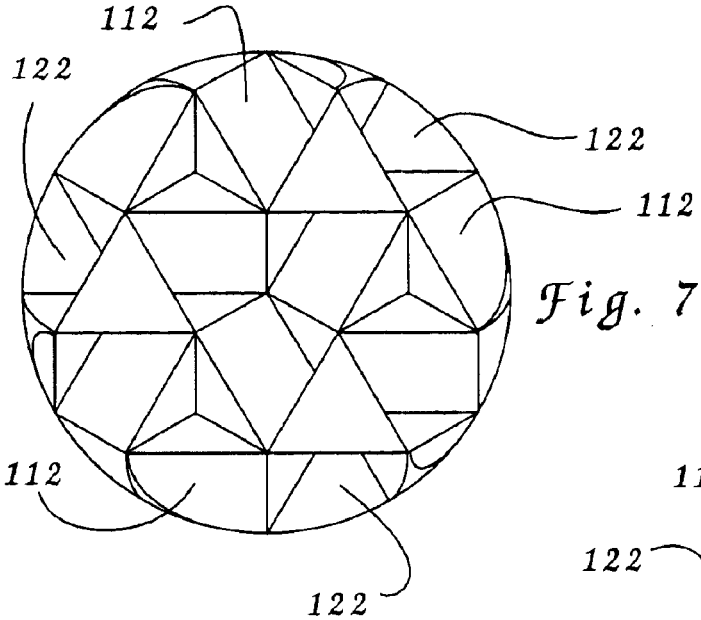
Fig. 72a
Fig. 72b
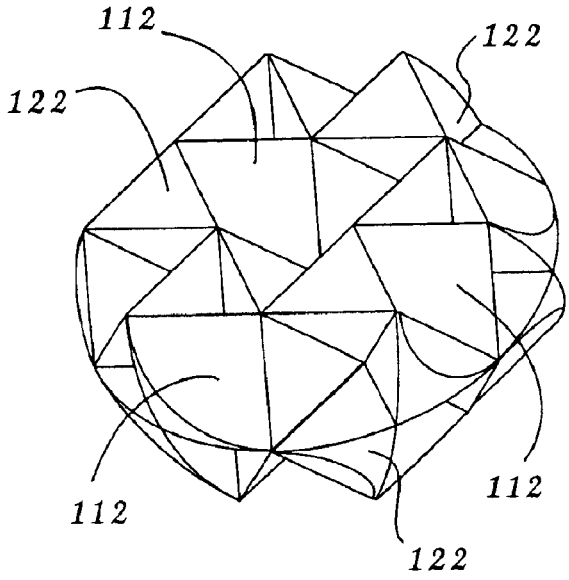
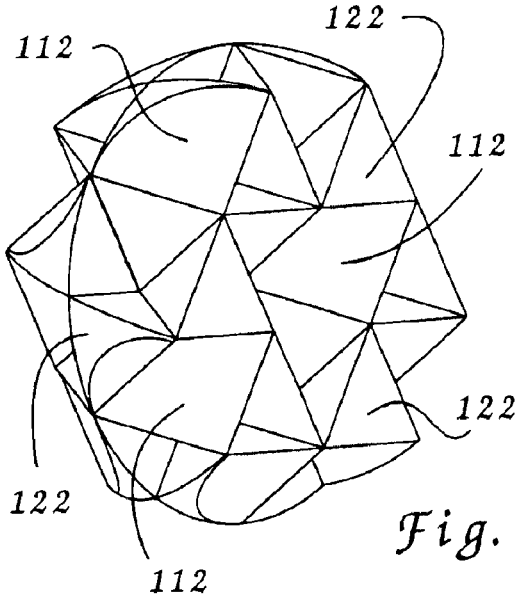
Fig. 72c
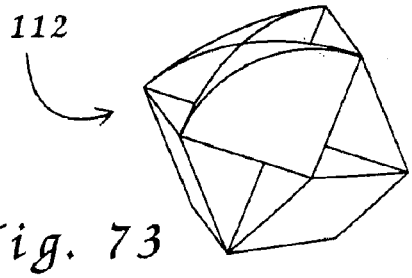
Fig. 73
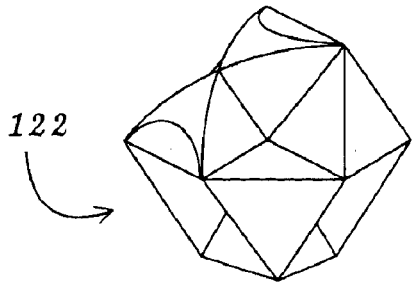
Fig. 74

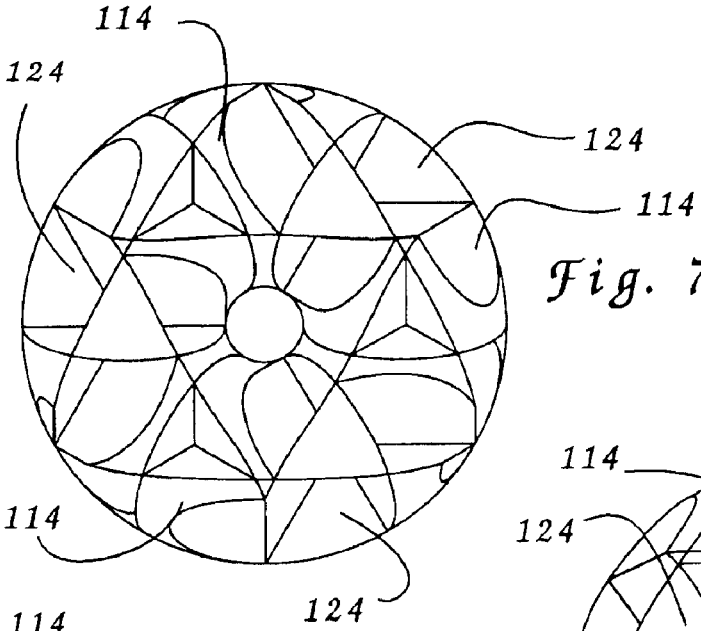
Fig. 75a
Fig. 75b
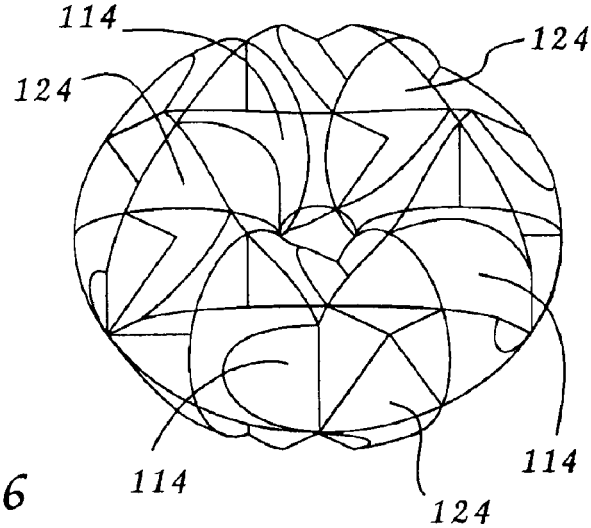
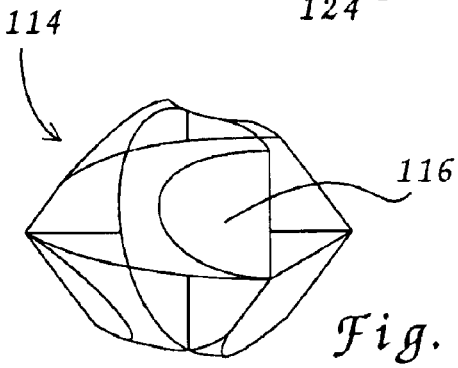
Fig. 76
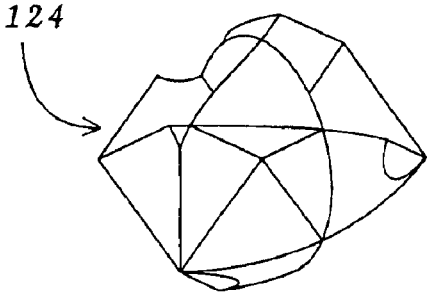
Fig. 77
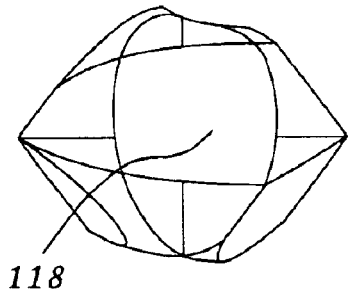
Fig. 78
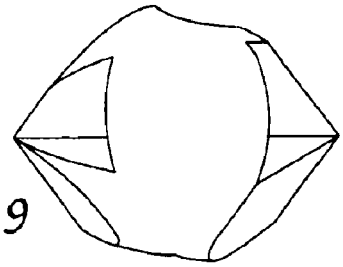
Fig. 79

INTERCLEAVING SPATIALLY DICHOTOMIZED POLYHEDRAL BUILDING BLOCKS AND EXTENSIONS

CROSS REFERENCE TO RELATED APPLICATIONS

This application is a continuation-in-part of U.S. patent application Ser. No. 09/266,010, filed Mar. 11, 1999, which in turn claims benefit of U.S. Provisional Patent Application Serial No. 60/077,908, filed Mar. 13, 1998, and Ser. No. 60/092,842, filed Jul. 14, 1998. This application further claims benefit of U.S. Provisional Patent Application Serial No. 60/318,828, filed Sep. 14, 2001. The disclosures of these four applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights rights whatsoever.

FIELD INVENTION

The current invention relates to a system for toy or real construction elements, which may also function as molecular and crystal modeling tools, and which may be implemented either directly in a physical form or indirectly in a virtual reality which is physically provided for by the hardware of a general purpose or dedicated computer system. The goals of the current invention are: 1) to provide educational, entertaining, and constructional value while providing a means of visualizing and exploring the principles and realms of space filling, space sharing, three dimensional tiling, and three dimensional fractals, as well as crystalline, quasi-crystalline, and other chemical compounds and/or structures; 2) to provide a new form of construction toy based on a new form of building blocks; 3) to provide the basis for a new genre of logic puzzles and 4) to provide an entertaining metaphor for many of life's challenges.

BACKGROUND ART

Prior to the current invention, most construction elements of any similar nature could be placed into one or more of four categories:

1) Stacking Blocks—which provide no means for self-retention of assembled structures, other than gravity; but require some form of bonding material if they are to be secured in their relative positions;
2) Member Suspended Interconnected Elements—which require rods or other secondary connective devices to determine and/or secure their relative positions in space;
3) Slotted Circular or Polygonal Discs—while interfitting or intercleaving, their teachings do not lend themselves to producing the non-planar elements required to emulate real world, molecular building blocks. Assemblies produced with such planar elements are not substantially space filled; and
4) Interfitting Surface Indentations—where complimentary patterns of protrusions and indentations provide for the alignment and mating of the surfaces of the generally polyhedral forms in a manner/direction which is orthogonal with respect to those mating surfaces.

No prior art has attempted to produce self-interfitting, self-retaining construction elements which produce substantially space-filled structures/assemblies. Most construction elements of prior design attempt to make their use more obvious and easy; while a significant portion of the current invention's value as an entertainment device and educational tool is the mystery, puzzlement, and challenges it presents due to the tendency of its various embodiments to retain the natural restraints associated with real-world elemental building blocks. Some examples of these natural restraints demonstrated by the elements of the current invention are as follows:

1) the restricted intercleaving nature of the elements may be used to demonstrate the intercleaving nature of covalent chemical bonds;
2) some of the required assembly and disassembly methods for the elements are analogous to thermal contraction and expansion in solids;
3) other assembly and disassemble methods emulate crystal growing and cleaving;
4) the natural inclination for the elements to produce mirror image (enatiomorphic) structures may be used to demonstrate and better understand both right-handed rotating (dextrorotary) and left-handed (levorotary) formations, such as during growth of organic substances or crystals;
5) the self-similar nature of assembled supersets of the elements of the invention may be used to emulate the development of polymer compounds from smaller polymer and monomer building blocks;
6) the self-similar nature of the assembled elements may also be used in creating complex embodiments and assemblies, enabling a new means of representing the fractal nature of the physical world; and
7) the ability of select embodiments of the invention to more naturally implement assemblies with five-fold symmetry may assist in demonstrating recently discovered chemical compounds with similar symmetries.

Accordingly, the building blocks (construction elements) of the invention are capable of not only modeling the net results of of molecular and crystal formation, but also of simulating the nature of the difficulties and processes involved in forming such chemical assemblages. Part of the challenge associated with the use of the current invention is that once one has determined which elements are needed and where each element must be placed, the user must still determine how to get them there; once again simulating the challenging nature of creating assemblies of chemical elements.

In summary, although many prior teachings demonstrate the combining of polyhedral elements into larger assemblies, each of them require some form of adhesive or secondary connection device or mechanism to implement the connection or to retain their interconnected alignments. Although most of the manufactures defined by the current invention do not result in fully space filled assemblages, all assemblies resulting from the use of the present invention are substantially more space-filling than any of the planar intercleaving manufactures of any prior art. No prior art provides generally polyhedral construction elements which non-perpendicularly mate, with respect to engaging surfaces, via interpenetrating vertices and/or edges. Finally no prior art provides the ability to produce the uniquely elegant assemblies enabled by the current invention.

SUMMARY OF THE INVENTION

The invention is a system and set of intercleaving (interfitting and adhering/clinging) elements which may be used as structural elements, building blocks, construction elements, modeling elements, or the like. Each of these discrete structural elements is comprised of a plurality of pyramids, or other polyhedral members, clustered around at least one central point in such a manner that the resulting cluster or clusters form a discrete structural element. The polyhedral members may be joined at least partially along coincident edges for maintaining the structural stability of the element. A portion of the joining coincident edges of the polyhedral members are slotted or not completely joined ("difurcated") on the outer half of the joining edge to facilitate interfitting of a first element with a second element.

Accordingly, each element of the invention has the ability to be interfitted with other complimentary elements in a mutually interfitting and adhering manner (i.e., "intercleaving") along the coincident edges of sets of diagonally adjacent polyhedral members (such as pyramids) which have been difurcated along an outermost portion of their coincident edges which radiate from their coincident central point. The primary mechanism for the mutual cleaving or adherence of the interfitted elements is friction, enhanced by wedging forces, due, in part, to the relatively narrow nature of these provided clefts, slots, or slits (collectively or interchangeably referred to as "difurcations") formed in the coincident edges of the polyhedral members which make up each element. However, the effectiveness of their intercleaving properties may be enhanced by the addition of a variety of standard techniques for increasing their resistance to disassembly, including, but not limited to, adhesives, locking mechanisms, and/or textures or other protrusions or undulations along their mating edges and/or surfaces.

Consequently, the present invention provides a unique structural element, building block, modeling element, construction component, or the like. (The terms "structural element", "construction element", "modeling element", "construction component", and "building block" are used synonymously and interchangeably throughout this document; and none is intended to be exclusive of any of the others.) The elements of the invention may be interfitted into a variety of configurations and arrangements. Thus, the present invention effectively combines a plurality of polyhedral members into discrete elements, and enables those elements to interfit with and adhere to complementary elements also formed of a plurality of polyhedral members. Accordingly, it will be apparent that the present invention provides a novel, aesthetic, and unconventional structural element.

BRIEF DESCRIPTION OF THE DRAWINGS

FIG. 1 illustrates a first embodiment 10 of a pentahedral-comprised structural element of the invention interfitting with a complimentary second embodiment 20 of a tetrahedral-comprised structural element of the invention.

FIG. 2 illustrates a pentahedral equilateral square based pyramid.

FIG. 3 illustrates a tetrahedral equilateral triangular based pyramid.

FIG. 15*a* illustrates an orthographic view of a cuboctahedron space definition perpendicular to one of its eight triangular surfaces.

FIG. 15*b* illustrates an orthographic view of the reverse of the cuboctahedron space definition of FIG. 15*a*, with the cuboctahedron having been flipped left to right.

FIG. 27 illustrates an enlarged view of a slit-implemented edge set difurcation of first element 10 of FIG. 1.

FIG. 28 illustrates an enlarged view of intercleaving diagonally adjacent pyramids of complimentary elements of FIG. 1.

FIG. 29 illustrates an enlarged view of a slot-implemented edge set difurcation of second element 20 of FIG. 1.

FIG. 30 illustrates an intercleaving complimentary pair of structural elements 10,20, similar to FIG. 1, with a fully filleted pentahedral-comprised structural element 10 and partially filleted tetrahedral-comprised structural element 20.

FIG. 31 illustrates an enlarged view of a fully filleted edge set and the resulting cleft and webbing.

FIG. 31*a* illustrates an enlarged view of a fully filleted edge set with a provisional cleft/difurcation implemented.

FIG. 31*b* illustrates a further enlarged, perpendicular view of the provisional cleft/difurcation illustrated in FIG. 31*a* provisional cleft/difurcation implemented.

FIG. 35 illustrates a pattern for producing a sheet material blank used to produce pentahedral-comprised structural element 10 of the first embodiment of the invention.

FIG. 36 illustrates a pattern for producing a sheet material blank used to produce a tetrahedral-comprised structural element 20 of the second embodiment of the invention.

FIG. 37*a* illustrates a perspective side view of a third embodiment of a combined structural element 70, which combines the first and second structural elements 10,20.

FIG. 37*b* illustrates a bottom view of the structural element 70 of FIG. 37*a*.

FIG. 37*c* illustrates a top view of the structural element 70 of FIG. 37*a*.

FIG. 39 illustrates a pattern for producing a sheet material blank used to produce structural element 70 of a third embodiment of the invention.

FIG. 44 illustrates a view depicting the challenge of adding a sixth element to an assemblage of five.

FIGS. 45*a* & 45*b* illustrate views of two mutually enatiomorphic hexagonal assemblages, with 45*a* being the goal of the challenge of FIG. 44.

FIG. 46 illustrates one of three methods of accomplishing one of the goals of FIG. 44.

FIG. 47 illustrates two emulated ring compounds interfitted to form a larger structure.

FIG. 54*a* & FIG. 54*b* illustrate two views of an Intercleaving Building Block based on, or extended/projected to, an Octahedron Space Definition, illustrating both peripherally based and radially based pyramid clustering.

FIG. 55 illustrates a view of the most basic (first-order) embodiment of an octahedron space definition.

FIGS. 56*a* & 56*b* illustrate two views of the element depicted in FIGS. 52*a* & 52*b* after being projected to an octahedron space definition.

FIGS. 57*a* thru 57*d* illustrate views of four Intercleaving Building Blocks based on an Icosahedron Space Definition, demonstrating more generalized definitions of an edge set, diagonally adjacent and facially adjacent polyhedrons, and complex/composite polyhedrons.

FIGS. 58*a* thru 58*c* illustrate three views of an Intercleaving Building Block based on a quindecahedron (15-faceted) space definition.

FIG. 63*a* illustrates an embodiment based upon fusing the assembly illustrated in, FIG. 40, comprised of a first embodiment element 10 interfitted with a second embodiment element 20, which are fused together to for a single contiguous element.

FIG. 63*b* illustrates a view of the element of FIG. 63*a* rotated 180 degrees.

FIG. 63*c* illustrate a bottom view of the element of FIG. 63*a*.

FIG. 64 illustrates an embodiment based on a fusing of three first embodiment elements 10 with a single centrally-located second embodiment element 20.

FIG. 65 illustrates an embodiment based on a fusing of three second embodiment elements 20 with a single centrally-located first embodiment element 10.

FIG. 66 illustrates the embodiment of FIG. 64 with the tetrahedral voids filled in.

FIG. 67 illustrates the embodiment of FIG. 65 with the central tetrahedral void filled in.

FIG. 68 illustrates a spheroidal embodiment 110 resulting from a spherical projection of first embodiment element 10.

FIG. 69 illustrates a spheroidal embodiment 120 resulting from a spherical projection of second embodiment element 20.

FIG. 70 illustrates a spheroidal embodiment 170 resulting from a spherical projection of third embodiment element 70.

FIG. 71 illustrates an assemblage of spheroidal embodiments depicted in FIG. 68 and FIG. 69.

FIG. 72*a* thru FIG. 72*c* illustrate the assemblage of first and second embodiments 10 & 20 after having been truncated by a sphere centered on the assembly, forming embodiments of FIG. 73 112 and FIG. 74 122.

FIG. 73 illustrates a spherically truncated embodiment 112 resulting from first embodiment element 10 being truncated by a relatively large sphere.

FIG. 74 illustrates a spherically truncated embodiment 122 resulting from second embodiment element 20 being truncated by a relatively large sphere.

FIG. 75 illustrates the assemblage of first and second embodiments 10 & 20 after having been truncated by a circular toroid centered on and aligned with the assembly, forming embodiments of FIG. 76 114 and FIG. 77 124.

FIG. 76 illustrates a truncated embodiment 114 resulting from first embodiment element 10 being truncated by a circular toroid.

FIG. 77 illustrates a truncated embodiment 124 resulting from second embodiment element 20 being truncated by a circular toroid.

FIG. 78 illustrates an embodiment resulting from the embodiment of FIG. 76 being further projected into the form of a toroid.

FIG. 79 illustrates an embodiment resulting from the embodiment of FIG. 78 being yet further projected into the form of a toroid.

DETAILED DESCRIPTION

Figure 4:
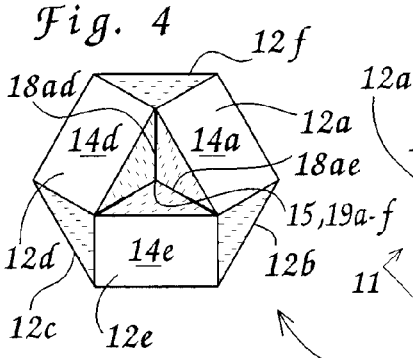
FIG. 4 illustrates a reduced-size view of the pentahedral-comprised structural element 10 of the first embodiment of the invention.

Best Modes for Carrying Out the Invention

Definition of Terms

The following generalized terms are here defined.

Blending of Surfaces—any smoothing deviation from the angular intersection of the planar polyhedron surfaces, or the increasing of intersection angles via the truncation of said intersections to form one or more additional planar facets or otherwise smooth surfaces.

Cell, Cell Definition—any defined portion of a space definition which is potentially physical/material (filled, occupied) or spatial (empty, unoccupied).

Cleaving—refers simultaneously or individually to both literal senses of the word, namely 1) to pierce, to split; to separate and 2) to adhere to; to cling to, to grasp.

Cleft—1) "an opening made by or as made by cleaving; crack; crevice" 2) "a hollow between two parts" (applied more generally herein as: between two or more parts); although the term cleft might usually imply a visibly noticeable gap, it is used herein to refer to any difurcation including slots or slits which may leave the separated edges/polyhedrons in contact but unconnected.

Cuboctahedron—a fourteen sided polyhedron whose faces consist of six equal squares and eight equal equilateral triangles, and which can be formed by cutting the comers off a cube.

Deltohedron—also known as: deltoid dodecahedron, or tetragonal tristetrahedron; a dodecahedron having twelve quadrilateral/tetragonal surfaces; including the rhombic dodecahedron.

Diagonally Adjacent—structures or, more specifically, polyhedral elements which adjoin or coexist along generally coincident or overlappingly collinear edge lines, or along any expansion of that common edge line used to facilitate their connection., but which share no common sides/surfaces, i.e. have no coincident or overlappingly coplanar surfaces, are said to be diagonally adjacent.

Difurcations 46—used herein as a more generalized equivalent of the word "bifurcated", meaning any separation/division of two or more elements of a manufacture resulting in a plurality of branches or peaks, while leaving the separated portions of the separated elements remaining in the same general proximity of each other; where said difurcations may include slots or slits which may leave the separated elements in contact but unconnected. The general use of this term is intended to include provisional difurcations 46*a*. In virtual manufactures, where difurcations may be infinitely narrow, the term may simply refer to [mean] any portion of the coincident lines of a manufacture's one dimensional edge set which is allowed to share their one dimensional space with the virtual difurcation of the one dimensional edge set of a similar manufacture. Therefore, in virtual reality, any or all edge sets may be thought of as being 100% difurcated.

Dodecahedron—a twelve faceted polyhedron.

Edge Set (Edgeset)—any cluster of two or more coincident polyhedral edges resulting from diagonally adjacent polyhedrons. An edge set is said to have been formed (to exist) if at least two diagonally adjacent material polyhedral elements and at least two spatial polyhedral elements share coincident edge lines.

Ellipsoidal—having the shape of a solid whose plane sections are all ellipses or circles, including spheroids and spheres.

Fillet—a fairing or other smoothing of the outline or shape of an element or structure.

Geodic Macro manufactures—geodic in form; "earthlike"; assemblages of embodiments of the current invention where said assemblages are generally spherical or otherwise ellipsoidal in shape and may encompass a central cavity, even though said ellipsoidal assemblages may also be viewed as being generally polyhedral in shape.

Implied Surface—1) any surface which is not physically present but whose presence is defined by, or suggested by the logical extension of, bounding and surrounding points, lines, and/or surfaces; i.e., logically extrapolated from surrounding features. 2) any surface of a specified space definition which limits any further extension of the definition of an otherwise defined spatial polyhedron or cell and, therefore, serves as a defining surface of said spatial polyhedron or cell.

Intercleaving—mutually cleaving elements; two or more elements which simultaneously interfit and/or cling to each other, with each element doing so with two or more protrusions.

Material—when used as an adjective and unless otherwise specified or obvious, its general use refers to being composed of either physical material or virtual material, except where virtual manufactures are not protected by law, in which case material becomes synonymous with physical. When used as a noun, its use is believed made clear by the context of each use.

Material/Physical Polyhedral Elements/Members—see below

Member Physical/Material

Polyhedral Elements/Members—may be solid, hollow, open faced, or framed (including wire-framed) in nature. Physical polyhedral elements may also be defined as any substantial occupancy of a polyhedral cell (i.e. subdivision) of a given space definition.

Plane of Inversion—any specified plane section of a three dimensional whole which delineates the portion of that whole which is to be spatially inverted and that portion which is to remain uninvested.

Polyhedron (polyhedrons, polyhedra)—any element/member which is generally polyhedral in shape, and unless otherwise specified, signifies physical/material polyhedrons as apposed to spatial polyhedrons.

Project—"to transform the points of a geometric figure into the points of another figure"; to extend and/or truncate the defining points of a manufacture to conform with the form of another geometric form or space definition. Such projections may be made between concentric space definitions or between space definitions whose centers have been offset. Similarly, the source and target space definitions need not be a synchronized, i.e. symmetrically aligned, but may be rotated with respect to each other in a manner resulting in a projected embodiment which does not retain the symmetry of either of its parent space definitions.

Provisional Difurcations, Provisional Clefts, Slots, and/or Slits 46*a*—any difurcation provided for, but not implemented during the primary manufacturing phase; where actual implementation of said Difurcations, as a subsequent manufacturing phase to be performed by intermediate or end users, is required, directed, or implied; or when the implementation of the actual difurcation might be reasonably expected to occur from reasonably expected use and/or experimentation; or where an impetus for implementing such difurcations is provided. Such an impetus may merely be a picture or diagram of a structure resulting from, or suggesting the interfitting of, so difurcated embodiments of the current invention. Such provisional difurcations would most often be implemented as noticeably thinner webbing, whereby a slit, slot, or wider cleft may be, at a later time, readily implemented, and is therefore facilitated, and thereby indirectly and/or cooperatively implemented. Such difurcations, clefts, slots, and/or slits may be said to have been provisionally implemented. If the provisional difurcation is sufficiently thin, the actual difurcation may be produced when complimentary manufactures are first interfitted by the end user during reasonably expected use or experimentation . . .

Quadecahedron—a fourteen faceted polyhedron, including the cuboctahedron.

Quindecahedron—a fifteen faceted polyhedron.

Rhombic Dodecahedron—a dodecahedron whose twelve facets are rhombuses.

Sculpted Surface—any surface which deviates from the theoretical planar or otherwise smooth or continuous surface of a generally defined shape. This term, as used in this document, is not intended to imply any given method of achieving these deviations.

Sculpting—Any blending or other deviation from the theoretical norm of a line, plane, or surface of a polyhedral or other geometric shape or form. Examples of which would include: undulations, serrations, gougings, dimplings, texturing, truncations, protrusions, projection (extension or truncation), filleting, or shrinking/recession from its theoretical or nominal definition/location. This term, as used in this document, is not intended to imply any given method of achieving these deviations.

Space Definition—any set of points and resulting peripheral planes defined by these points, or any other specified planar or curved surfaces or geometric form, which define the confines of a limited universe of space/matter under consideration, which in turn defines the basic shape/form of and, therefore, acts as the base/body of a subject manufacture providing the basis by which: 1) the limits of the space within which specified polyhedral elements are positioned is defined; 2) the relative locations of facet-based material and/or spatial pyramidal formations are defined; or 3) the form/limits of the further projection/extension/truncation of an otherwise defined manufacture is/are further defined. An example of a space definition would be the regular cuboctahedron whose twelve peripheral points (vertices) define the fourteen peripheral planar surfaces 30 & 32 (FIGS. 15*a* & 15*b*) which form the confines of each of the two components of the complimentary pair of preferred embodiments of the current invention described herein as the first and second embodiments 10,20 (FIG. 1), and which further defines the bases of the pyramidal elements of each cuboctahedral embodiment.

Spatial Dichotomization—dividing or redefining a material or spatial whole into material and spatial elements/sections.

Spatial Inversion—a reversal of the material or spatial specification/definition of one or more elements; changing a portion or the entirety of one or more elements of a material or spatial whole into its material/spatial inverse.

Substantially Complementary—elements which are sufficiently complimentary of each other to allow some portion of themselves to interfit within and/or around each other, i.e., to intercleave. The use of "complementary" throughout this document is intended to be synonymous with "substantially complementary".

Virtual—for practical purposes the same as . . .

Virtual Manufacture—computer generated manufactures/objects for manipulation by a computer or computer operator and/or display on/in any two or three dimensional display or stereo viewer designed to be used by such computers. Virtual reality is no longer merely an academic tool, but has become a very real medium for the manifestation of competitively manipulatable manufactures. Such manufactures, whether viewed on a two-dimensional display, in the perceived space produced by a virtual reality helmet, or manifested in some futuristic three-dimensional display or medium, may be moved across the user's field of vision or interfitted with other such manufactures. The specific computer hardware, software, and algorithms used to dynamically manufacture, manipulate, and/or render a display of a virtual manufacture are as secondary to the resulting virtual manufacture as are the machinery, materials, and manufacturing techniques and processes used are to an otherwise identical physical manufacture.

Virtual Matter—any defined set of points in a virtual reality which is not allowed to be or is otherwise restricted in some manner and/or degree from being shared with any similarly defined set of points. (In any given virtual reality it is possible to modify "the laws of physics", as we normally think of them, to allow conditional sharing of space by two or more sets of "matter".) Any such set of points may be moved, modified, or otherwise manipulated in accordance with a set of "laws of physics" as defined for the specific virtual reality in which said virtual matter has been defined.

Virtual Medium—the mechanism by which a virtual reality is effected

Virtual Reality—any manipulatable existence comprised of virtual space and virtual matter/material.

Virtual Space—any portion of a virtual reality which is available for unrestricted occupancy by virtual matter/material.

Webbing—the material provided to connect diagonally adjacent polyhedrons to each other along a portion of their coincident edges. In virtual manufactures, where webbing may be infinitely narrow, the term may simply mean the inner portion of the coincident lines of a manufacture's one dimensional edge set which are not allowed to share their one dimensional space with the virtual webbing of the one dimensional edge set of a similar manufacture.

DESCRIPTION OF PREFERRED EMBODIMENTS

The invention is directed to a set and system of interfitting structural elements which may be used for building structures, creating models, amusing and entertaining people, or the like. FIG. 1 illustrates a first embodiment 10 of a pentahedral-comprised structural element of the invention being interfitted with a second embodiment 20 of a tetrahedral-comprised structural element of the invention. The first and second preferred embodiments of the current invention are a complementary pair of first and second structural elements 10, 20, respectively, each being the spatial inverse of the other. Neither of these two embodiments 10, 20 are intended to be interfitted with identical elements, but instead, are paired with each other or with other substantially complimentary embodiments. However, the second embodiment 20 of the two elements is capable of being mated with identical elements 20 in a partially complimentary manner, producing some unique capabilities.

For purposes of clear explanation, FIGS. 2 and 3 are provided to illustrate basic shapes used in first pentahedral-comprised structural element 10 and second tetrahedral-comprised structural element 20. FIG. 2 illustrates an equilateral, pentahedral, squared based, pyramid 12 of the invention. Pyramid 12 has a square base 14 and four equilateral triangle radial sides 16 which are joined at their respective edges 18, and which meet at a summit or apex 19. FIG. 3 illustrates an equilateral, tetrahedral pyramid 22 having a triangular base 24 and three identical equilateral triangle radial sides 26 which are joined at their respective edges 28, and which meet at a summit or apex 29. It will be apparent that the base 24 and sides 26 of tetrahedral pyramid 22 are distinguishable from each other based only upon orientation (i.e., base 24 is identical in size and shape to each of sides 26), whereas the base 14 of pentahedral pyramid 12 is distinguishable from sides 16 based upon size and shape.

Figure 5:
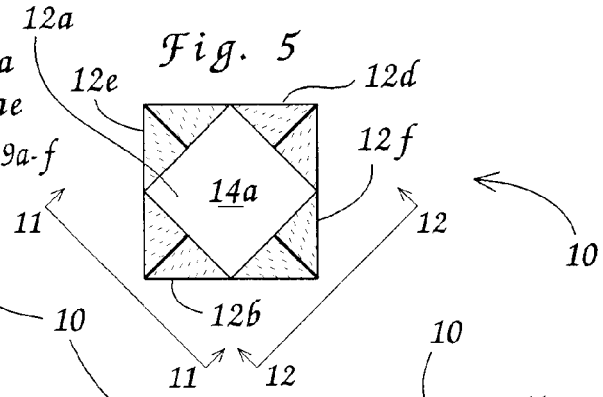
FIG. 5 illustrates a plan view of the structural element 10 of FIG. 4.
Figure 9:
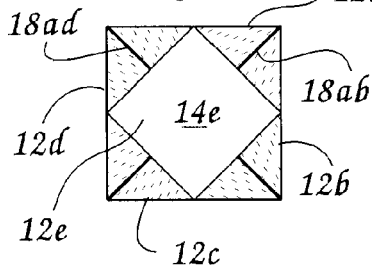
FIG. 9 illustrates a left side view of the structural element 10 of FIG. 5
Figure 6:
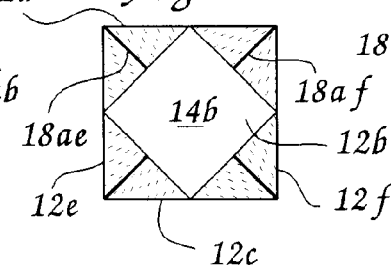
FIG. 6 illustrates a front view of the structural element 10 of FIG. 5.
Figure 10:
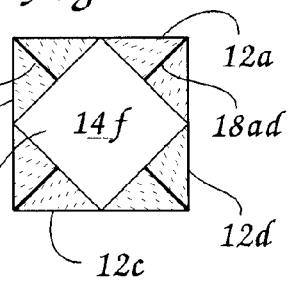
FIG. 10 illustrates a right side view of the structural element 10 of FIG. 5.
Figure 7:
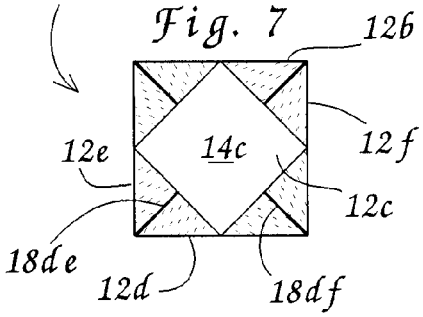
FIG. 7 illustrates a bottom view of the structural element 10 of FIG. 5.
Figure 11:
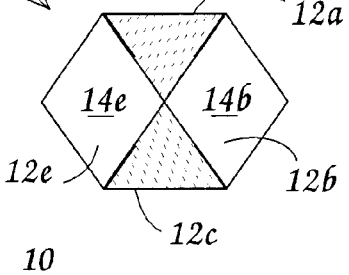
FIG. 11 illustrates a Left-Front orthographic view of the structural element 10 illustrated in FIG. 6, rotated 45 degrees to the right.
Figure 12:
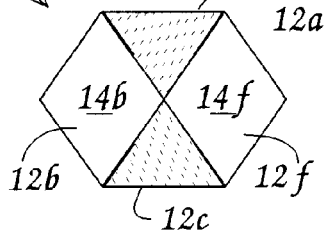
FIG. 12 illustrates a Right-Front orthographic view of the structural element 10 illustrated in FIG. 6, rotated 45 degrees to the left.
Figure 8:
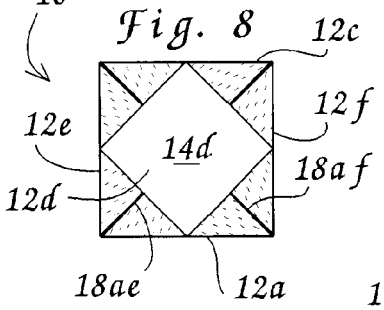
FIG. 8 illustrates a rear view of the structural element 10 of FIG. 5.
Figure 13:
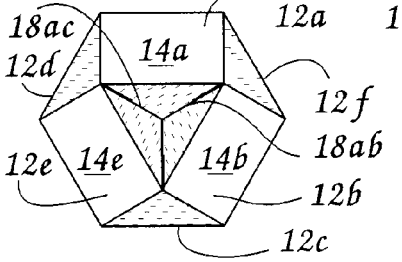
FIG. 13 is an orthographic view of the structural element 10 depicted in FIG. 11 20 rotated front-down approx. 35.25 degrees, doubling as an isometric view.
Figure 14:
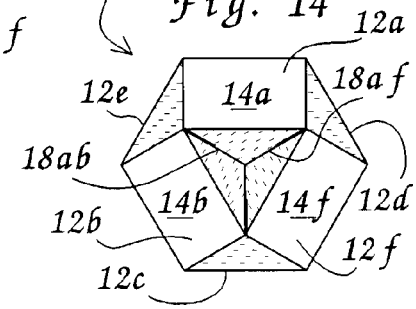
FIG. 14 is an orthographic view of the structural element 10 depicted in FIG. 12 rotated front-down approx. 35.25 degrees, doubling as an isometric view.
Figure 16:
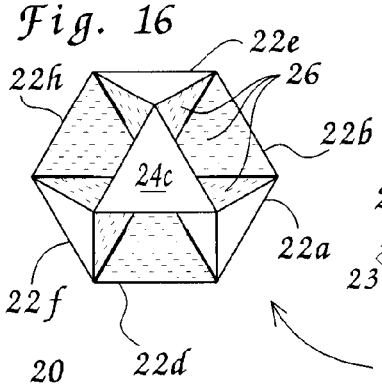
FIG. 16 illustrates a reduced-size view of the tetrahedral-comprised structural element 20 of the second embodiment of the invention.
Figure 17:
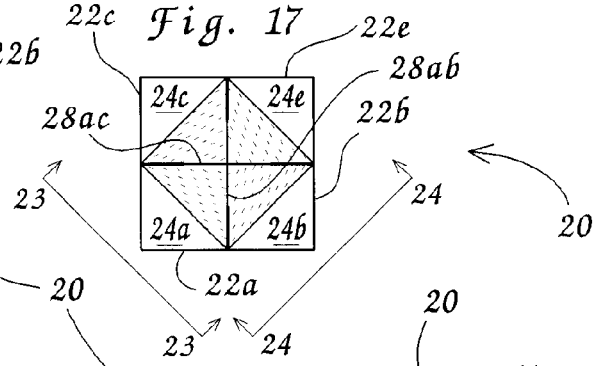
FIG. 17 illustrates a plan view of the structural element 20 of FIG. 16.
Figure 21:
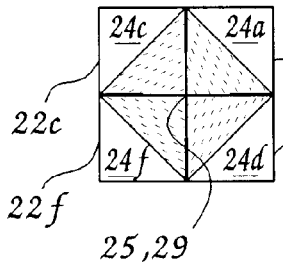
FIG. 21 illustrates a left side view of the structural element 20 of FIG. 17
Figure 18:
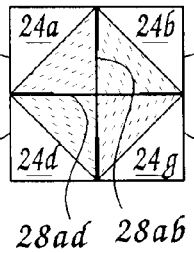
FIG. 18 illustrates a front view of the structural element 20 of FIG. 17.
Figure 22:
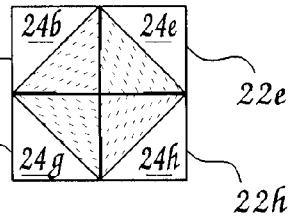
FIG. 22 illustrates a right side view of the structural element 20 of FIG. 17.
Figure 19:
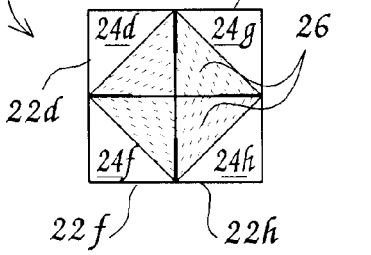
FIG. 19 illustrates a bottom view of the structural element 20 of FIG. 17.
Figure 23:
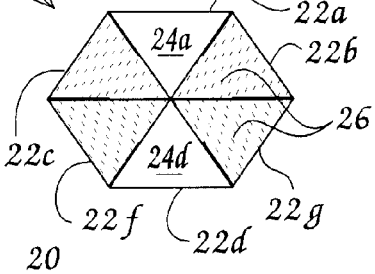
FIG. 23 illustrates a Left-Front orthographic view of the structural element 20 illustrated in FIG. 18, rotated 45 degrees to the right.
Figure 24:
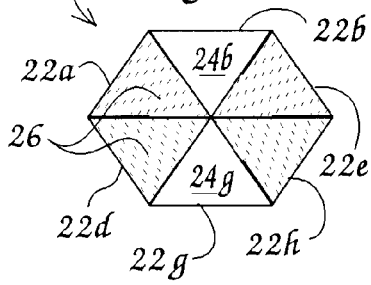
FIG. 24 illustrates a Right-Front orthographic view of the structural element 20 illustrated in FIG. 18, rotated 45 degrees to the left.
Figure 20:
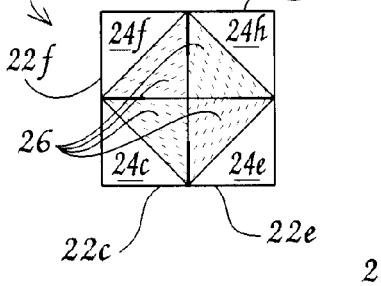
FIG. 20 illustrates a rear view of the structural element 20 of FIG. 17.
Figure 25:
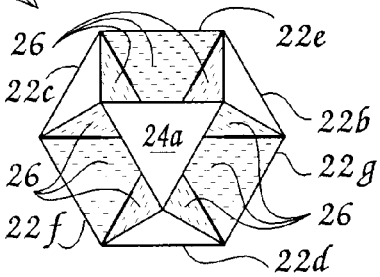
FIG. 25 is an orthographic view of the structural element 20 illustrated in FIG. 23 rotated front-down approx. 35.25 degrees, doubling as an isometric view.
Figure 26:
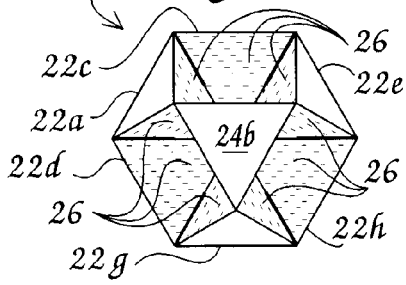
FIG. 26 is an orthographic view of the structural element 20 illustrated in FIG. 24 rotated front-down approx. 35.25 degrees, doubling as an isometric view.
Figure 32:
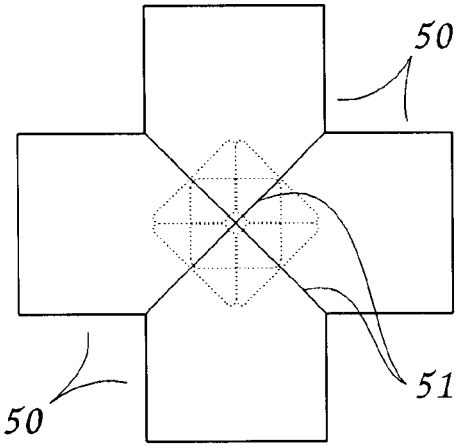
FIG. 32 illustrates a schematic diagram depicting/suggesting an approach to a four-piece molding system for producing structural element 10, shown in closed/engaged position.
Figure 33:
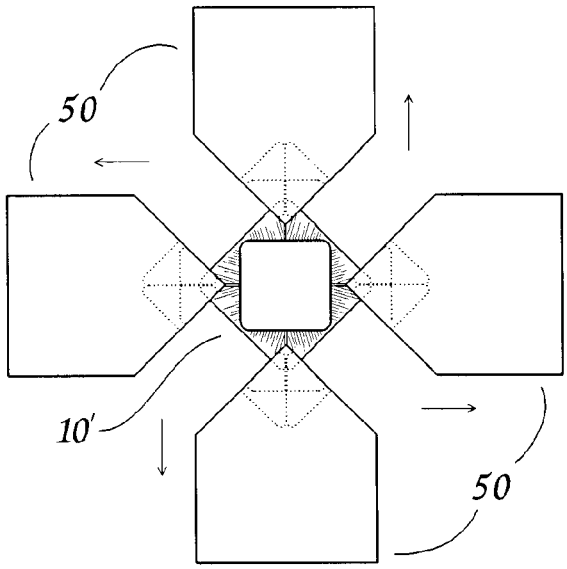
FIG. 33 illustrates a schematic diagram of the four-piece molding system of FIG. 32 shown releasing a molded structural element 10.
Figure 34A:
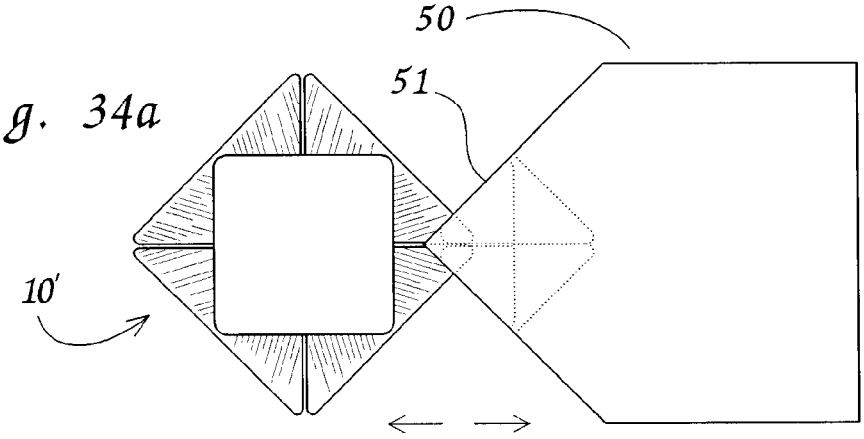
FIG. 34*a* illustrates an enlarged top view of one of the four identical molding dies depicted in FIGS. 32 & 33, shown disengaging the newly formed structural element 10.
Figure 34B:
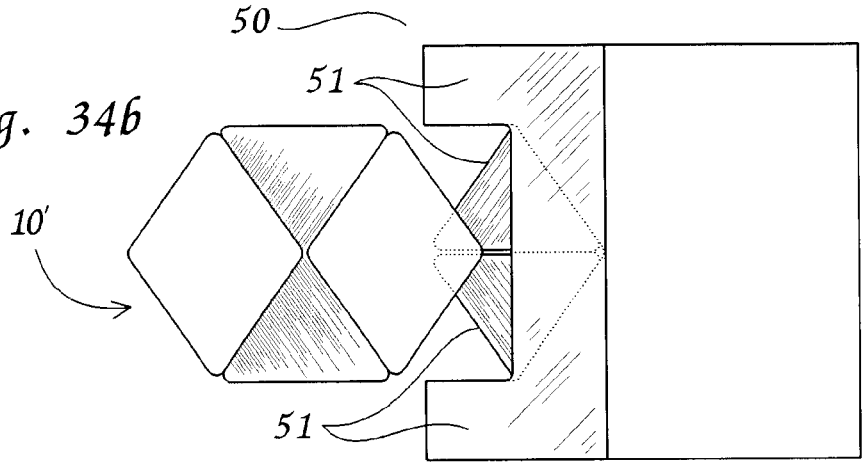
FIG. 34*b* illustrates a side view of the die and manufacture depicted in FIG. 34*a*.

FIGS. 4–14 further illustrate pentahedral-comprised structural element 10 of the first embodiment of the invention. Pentahedral-comprised element 10 is comprised of six equilateral pentahedral, square-based pyramids 12*a*–12*f* arranged in a clustered manner which results in their six apexes or summits 19 being coincident at a single central point 15, and each of the four radial edge lines 18 of each pyramid 12*a*–12*f* being coincident with one edge line 18 of each of four diagonally adjacent pyramids 12*a*–12*f*. For example, as illustrated in FIG. 5, four pyramids 12*d*, 12*f*, 12*b*, & 12*e*, are diagonally adjacent to pyramid 12*a*, with each pyramid 12*d*, 12*f*, 12*b*, & 12*e* sharing a single radial edge line 18*ad*, 18*af*, 18*ab*, & 18*ae*, respectively, with pyramid 12*a*, as illustrated in FIGS. 4 and 6–14. Furthermore, pyramid 12*a* is diametrically opposed to a fifth pyramid 12*c*, and pyramid 12*c* is also diagonally adjacent to the four pyramids 12*d*, 12*f*, 12*b*, & 12*e*. Thus, each of the six pyramids 12*a*–12*f* is centrally disposed relative to four diagonally adjacent pyramids 12*a*–12*f*, and diametrically opposed to a fifth pyramid 12*a*–12*f*.

With pyramids 12*a*–12*f* so arranged, their six peripherally oriented square bases 14 correspond to six square surfaces or facets 30 of a cuboctahedron space definition, as illustrated in FIGS. 15*a* & 15*b*; and as such, these pyramids 12*a*–12*f* may be referred to as facet-based pyramids, where a facet of the basic form (space definition) of the structural element functions as the base of each of the subject pyramids 12*a*–12*f*. In this case, the basic form of first structural element 10 is a cuboctahedron. A cuboctahedron is a fourteen sided polyhedron whose faces or facets consist of six equal squares and eight equal equilateral triangles, and which can be formed by cutting the comers off a cube. It may be seen from FIG. 1 that structural elements 10,20 are both based upon the cuboctahedron structure/form, but are spatial inverses of each other. Accordingly, portions of element 10 are able to fit into spaces in element 20 and vice versa. Further, it will be apparent that the bases 14 of each pentahedral pyramid 12 are located in accordance with the square facets 30 on the cuboctahedral space definition, and bases 14 may be described as facets of first element 10.

Thus these pyramids are each based at/on the facets of the polyhedral form which the structural element, as a whole, is based upon, and where this polyhedral form may be referred to as the base or body of the structural element, the facets of said polyhedral form/space definition form or provide for the bases of the facet-based pyramids. Thus, the arrangement of first element 10 includes eight spaces (i.e., voids, recesses, or open areas) in the shape of eight spatial tetrahedral pyramids 22 being interspersed between and defined by the twenty-four radial sides 16 of the six pentahedral pyramids 12*a*–12*f*. There are eight implied triangular peripheral surfaces (openings) corresponding to the eight triangular surfaces 32 of the cuboctahedron space definition. Thus these tetrahedral pyramidal voids/recesses (spatial pyramids) are each based at/on an implied facet of the polyhedral form which the structural element, as a whole, is based upon, and may also be referred to as facet-based. (For the sake of clarity, numerical designations or lead lines to define the spatial areas of the current invention are generally not provided in the included drawings. Attempts to point to an open three dimensional space in/on a two-dimensional presentation can prove to be more confusing than clarifying.) Accordingly, first element 10 includes six physical pentahedral pyramids 12*a*–12*f*, which are arranged about central point 15, with their edges 18 aligned with adjacent edges 18 of pyramids 12*a*–12*f*, so that there are eight voids between pyramids 12*a*–12*f* in the shape of eight tetrahedral pyramids 22. These eight pyramidal voids may also be viewed as being pyramidal recesses in the generally cuboctahedral body of the construction element, resulting, effectually, from the recession of the eight triangular facets 32 of the cuboctahedron form/base/body toward their common central point 15. The six physical pentahedral pyramids 12*a*–12*f* may also be viewed as resulting, effectually, from the extension the six square facets 30 of the cuboctahedral form/base/body toward their common central point 15 (or as the extension of the edges of those facets, forming hollow pyramids). It can be seen that the natural consequence of these recessions and extensions of the surfaces/facets of a cuboctahedron is the prescribed edge alignments of the resulting diagonally adjacent material pyramids 12*a*–12*f*, as well as a similar alignment of the resulting spatial pyramids.

Turning now to the second structural element 20 of the invention, tetrahedral-comprised structural element 20 of the second embodiment of the invention is illustrated in FIGS. 16–26. Tetrahedral-comprised element 20 is comprised of eight equilateral tetrahedral pyramids 22*a*–22*h* arranged in an edge-aligned manner around a single coincident center point 25, with apexes 29 located at center point 25. For example, the edges 28 of tetrahedral pyramid 22*a* are aligned with the edges 28 of tetrahedral pyramids 22*b*, 22*c*, and 22*d*, and are shown as reference numbers 28*ab*, 28*ac*, and 28*ad*, respectively. Thus, each tetrahedral pyramid 22*a*–22*h* has its edges 28 adjacent to and aligned with the edges 28 of three other tetrahedral pyramids 22*a*–22*h*.

It will be apparent that tetrahedral pyramids 22*a*–22*h* of element 20 are also arranged within the same cuboctahedron space definition (FIGS. 15*a* & 15*b*) as for pentahedral-comprised structural element 10 of the first embodiment. Thus, the arrangement of second element 20 results in the volume of six spatial pentahedral pyramids 12 being interspersed between and defined by the twenty-four radial surfaces 26 of the eight physical tetrahedral pyramids 22*a*–22*h* and the six implied square surfaces (i.e., openings) corresponding to the six square surfaces 30 of the space definition, while the eight peripherally-based triangular surfaces 24*a*–24*h* of the tetrahedral pyramids correspond to the eight triangular surfaces 32 of the space definition. Accordingly, any of the tetrahedral pyramids 22*a*–22*h* is coincident along its three edges 28 with the edges 28 of three other tetrahedral pyramids 22*a*–22*h*, with the apexes 29 of the tetrahedral pyramids 22*a*–22*h* located at center point 25, and with six pentahedral voids dispersed between the aligned tetrahedral pyramids 22*a*–22*h*. Furthermore, as described above with respect to the first embodiment 10, bases 24 of tetrahedral pyramids 22 correspond to the triangular facets 32 of the cuboctohedral space definition, and may be described as facets of second element 20. Therefore, with the recessions and extensions of the facets 30, 32 of the cuboctahedron space definition reversed, the prescribed edge alignments of the resulting eight diagonally adjacent material tetrahedral pyramids 22*a*–22*h* of second structural element 20 are achieved, as well as a similar alignment of the resulting six spatial pentahedral pyramids.

Turning back to FIG. 1, inpentahedral-comprised element 10, each pair of diagonally adjacent pyramids 12 has coincident radial edge lines 18 which form an edge set 40 where the edges 18 of pyramids 12 meet. Similarly, in tetrahedral-comprised element 20, each pair of diagonally adjacent pyramids 22 forms an edge set 40 along their coincident radial edge lines 28. Thus, an edge set 40 may be defined as any cluster of two or more coincident polyhedral edges resulting from diagonally adjacent polyhedrons. An edge set 40 is said to have been formed (to exist) if at least two diagonally adjacent physical polyhedral elements and at least two spatial polyhedral elements share coincident edge lines. In the case of first and second elements 10 & 20, it can be seen that the natural consequence of the previously describe material recessions and extensions of the facets of their cuboctahedron form is the formation of these edge sets at the vertices 17, 27 of their cuboctahedral forms/bases/bodies, i.e. at the vertices 37 of their defining cuboctahedron space definition, and that these edge sets naturally radiate from their central points 15, 25 towards, and terminating at, those vertices 17, 27; or may be otherwise viewed as radiating inward from those vertices 17, 25 toward their common central points 15, 25. Furthermore, and again as a natural consequence of these edge sets radiating from the apexes of these pyramidal extensions and recessions, these edge sets define and lie on a plurality of nonparallel planes. In the case of these cuboctahedral based elements 10, 20, these edge sets 40 define four mutually oblique and nonparallel planes intersecting at their coincident central points 15, 25. Each of their edge sets are, therefore, obliquely noncoplanar with and nonparallel to at least one pair of coplanar edge sets.

Figure 48:
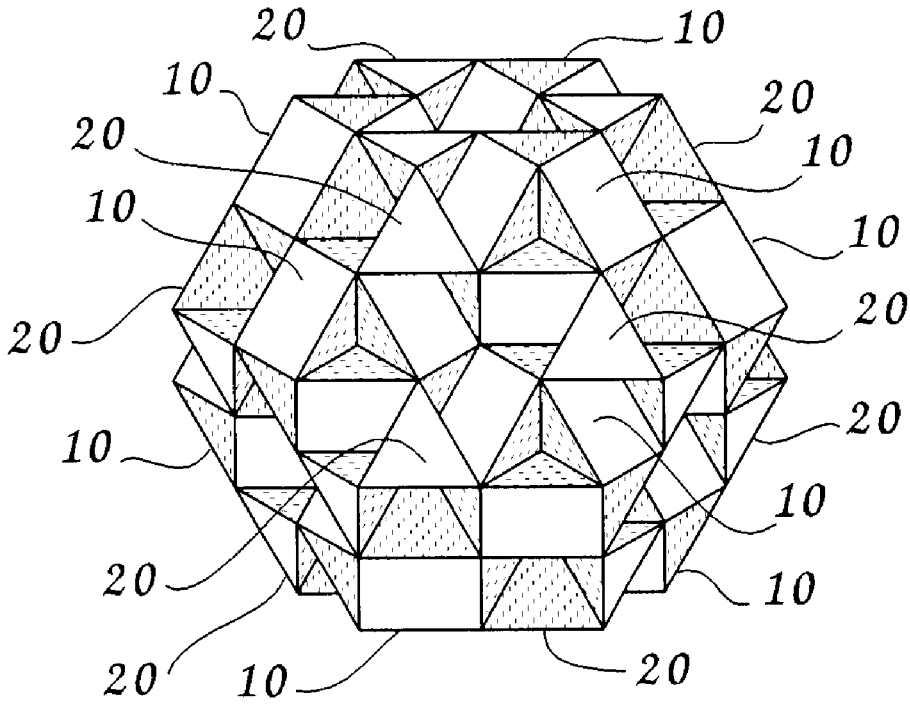
FIG. 48 illustrates a geodic assemblage of twenty-four elements, twelve elements 10 and twelve elements 20.

It can be seen that this obliquely noncoplanar and nonparallel relationship exists between the radial edges of any pyramid; and that it is this relationship which allows the formation of some of the unique three-dimensional assemblages enabled by the current invention such as the one depicted in FIG. 48.

In the embodiments 10,20 of FIG. 1, and as also illustrated in FIGS. 27–29, the diagonally adjacent pyramids 12,22, respectively, are interconnected along an inner portion of edge sets 40 by what will hereinafter be referred to as webbing 44 and are separated along an outer portion of these edge sets 40 by clefts 46 (also referred to as "difurcations"). Webbing 44 is the connecting material or filleting which is a necessary part of manufacturing a physical element 10, 20, and which are also necessary for maintaining structural integrity of elements 10,20, by holding the polyhedral members in position. Clefts 46 extend inward from the outermost point of the edge sets 40, resulting in what will be referred to as difurcated edge sets 48. These clefts 46, alternately referred to as difurcations 46, may also be viewed as spatially connecting the diagonally adjacent spatial pyramids.

In each of the two preferred embodiments 10,20, all twelve of the resulting edge sets 40 are equally difurcated to a depth equal to at least fifty percent of the edge set's 40 length. However, as long as structural integrity is maintained, each difurcation 46 may extend along any outer portion of the edge set's 40 length, including its entirety, with a complementary portion of the length of the appropriate edge set 40 of an intended mating element 10, 20 being suitably difurcated. In an extreme example, an edge set 40 of a first element 10 may be 100 percent difurcated, ana complimentary edge set 40 on a second element 20 may be undifurcated, and still be able to mate first element 10.

In FIGS. 27–29, it can be seen that it is these clefts 46 which allow a pair of pentahedral pyramids 12 of first element 10, or a portion of them, to protrude into a pair of spatial pentahedral pyramids in second element 20 while the pair of physical tetrahedral pyramids 22 associated with the mating edge set 40 of second element 20 protrude into the pair of spatial tetrahedral pyramids associated with the relevant edge set 40 of the first element 10, in a mutually cleaving manner. During insertion, the webbing material 44 connecting the inner portion of the edge sets 40 of each element 10,20 simultaneously slides into the clefts 46 of the other element 10, 20, as the elements 10, 20 become fully seated within each other. In the preferred embodiments, the webbing material 44 connecting the inner portion of the edge sets 40 is tapered and slightly wider than the clefts 46, providing greater wedging forces, to increase the frictional resistance to disassembly once fully assembled. This may be balanced against similar tapering of the clefts 46, as illustrated in FIG. 27, providing for easier mating and greater angular tolerance when interfitting multiple construction elements.

These clefts 46, which can be seen in greater detail in FIGS. 27–29, may be no more than slits as in FIG. 27, or slots as in FIGS. 28 and 29, or even broader. Clefts 46 are represented in unenlarged drawings, such as FIGS. 4–14 and 16–26, by broader lines, or not indicated at all, since not all edge sets which may be suitable for difurcation need be difurcated in given manufacture. Furthermore, it will be apparent that each edge set 40 is non-perpendicular (oblique) to the facets (bases 14, 24) which make up the polyhedrons forming that edge set 40. For example, in first element 10, two pentahedral pyramids 12 have aligned coincident edges 18 which form an edge set 40. However, bases 14 of these two pentahedral pyramids form planar surfaces or facets which are non-perpendicular to the edge set 40, and which are also non-parallel to the edge set 40. This feature contributes to the non-intuitive manner in which the elements 10, 20 of the invention interfit with each other. It can further be seen that this non-orthographic relationship is due to the manner in which these edge sets 40 peripherally terminate at the vertices 17, 27 of the generally polyhedral elements, or, as in the embodiments depicted in FIGS. 54*a*, 54*b*, 56*a* and 56*b*, may be alternately achieved by edge-terminating edge sets 40*b* which terminate along the edges of the construction element's generally polyhedral form (space definition). Such references to terminations at or along vertices or edges are irrespective of any truncation or filleting of those vertices or edges.

It should be further noted that the preferred embodiments described thus far have spherical symmetry. Accordingly, edge sets 40 radiate symmetrically in a radial manner from central point 15,25, so that elements 10,20 may be described as being spherically symmetrical. This facilitates connecting elements 10, 20 to other elements 10, 20 from a plurality of sides and angles, thereby increasing the variety of structures which may be formed by elements 10,20.

FIGS. 30–31 illustrate slightly modified elements 10', 20' of FIG. 1, in which substantial filleting is added to the webbing 44 and clefts 46. Pentahedral-comprised element 10' includes a fully filleted webbing 44 and large clefts 46. In addition, all other edges of modified element 10 are rounded off, without changing the essential shape of element 10'. Similarly, modified tetrahedral-comprised element 20' includes fully filleted webbing 44 and large clefts 46, but is not rounded off on the outer edges in the manner of modified first element 10'. The modified elements 10', 20' would be more practical for manufacture by molding or the like, without substantially changing the function or appearance of the elements.

FIGS. 31*a* and 31*b* provide details of a provisionally implemented cleft/difurcation (provisional difurcation 46*a*). Provisional difurcations, clefts, slots and/or slits 46*a* are any difurcation provided for, but not implemented during the primary manufacturing phase; where actual implementation of the difurcations, as a subsequent manufacturing phase to be performed by intermediate or end users, is required, directed, or implied; or when the implementation of the actual difurcation might be reasonably expected to occur from reasonably expected use and/or experimentation; or where an impetus for implementing such difurcations is provided. Such an impetus may merely be a picture or diagram of a structure resulting from, or suggesting the interfitting of, so difurcated embodiments of the current invention. In this case, the provisional difurcation 46*a* is implemented as noticeably thinner webbing, whereby a slit, slot, or wider cleft may be, at a later time, readily implemented, and is therefore facilitated, and thereby indirectly and/or cooperatively implemented. Such difurcations, clefts, slots, and/or slits may be said to have been provisionally implemented. If the provisional difurcation is sufficiently thin, the actual difurcation may be produced when complimentary manufactures are first interfitted by the end user during reasonably expected use or experimentation.

The best method of manufacture of the preferred embodiments is considered to be injection molding of a solid one piece element, where all of the described features are implemented simultaneously. Such an implementation would require molds consisting of at least four parts as suggested by FIGS. 32–34*b*. These diagrams illustrate a set of four identical dies 50 being used to form modified first element 10' with fully filleted features, as depicted in FIG. 30; though not all details of such a mold are presented here. For example, the details required to implement the other eight difurcated edge sets which lie along the mating planes 51 of the four dies are not shown, but the manufacturing of the elements 10, 20 is believed to be within conventional skills of those skilled in the art, and, accordingly, no additional description is believed to be required.

A similar system may be employed for the manufacture of the second described embodiment element 20. However, at least two differing pairs of identical dies may be required. Also, the use of more than the minimum number of component dies may be desirable particularly where regular retooling for a variety of embodiments is expected, or to simply minimize the visibility of resulting seams. The molding of any embodiments of the current invention may directly form the required clefts 46, or the clefts 46 may be provided as a subsequent step. This additional step(s) might involve any of a variety of machining processes or a literal cleaving of the edge sets 40.

A forced mechanical cleaving of the edge sets 40 would, assuming that other design characteristics, including webbing thickness and resiliency of used materials, allow the use of slits as clefts 46, provide particularly stealthy difurcations. Also, the resiliency of an appropriate manufacturing material would tend to re-close the formed clefts 46, making them less visible and more puzzling. The central portion of hollow versions of these manufactures may be similarly molded without the peripheral surfaces (e.g., pyramid bases 14 could be left out during the molding process, with pyramids 12 being hollow). These surfaces could be subsequently added using standard techniques. If these peripheral surfaces 14, 24 were not added, the resulting manufacture would be considered to be comprised of open faced pyramidal members.

An alternate method of manufacture would be to use adhesives or other bonding materials or techniques to assemble discrete 25 polyhedral members into the forms described/claimed as the current invention.

Two computer controlled manufacturing techniques which may be particularly 20 valuable for creating prototypes, if not production models, of the numerous possible variations on the preferred embodiments are: Successive Layer Deposition; and Convergent Beam Polymer Solidification. Similarly, elements 10,20 may be machined from solid stock using automated numerically controlled equipment.

In yet another manufacturing method, prototypes of various embodiments of the current invention have been created from sheet materials using patterned blanks similar to the ones depicted in FIGS. 35 & 36. In brief, the blank of FIG. 35 is comprised of (a continuum of) six generally square and 24 generally equilateral triangular panels further provided with a plurality of securing/gluing tabs for securing the panels in position once folded into the spatially dichotomized cuboctahedron which, when provided with difurcated edge sets by the blank's further provided slits/slots, forms first structural element 10. This blank may be alternately viewed as being comprised of six square and eighteen triangular panels distributed about a central, generally equilateral, hexagonal panel. The blank of FIG. 36 is similarly comprised of 32 generally equilateral triangular panels (or 26 distributed about a central hexagonal panel) also provided with a plurality of securing/gluing tabs which, once folded, forms the spatially inversed spatially dichotomized cuboctahedron which, when provided with difurcated edge sets by the provided slits/slots, forms second structural element 20. In both cases, the hexagonal central panel may be viewed as a continuum of six triangular panels which remain coplanar (unfolded) after all folds have been completed.

These blanks have been used to produce prototypes of pentahedral-comprised element 10 and tetrahedral-comprised element 20, respectively. Each of these blanks is cut along the solid lines 58, including the slits 59, but excluding the lines associated with the center reference marking 60; and then folded toward its printed side along the dashed lines 61 and folded toward its unprinted side along the dotted lines 62. The resulting tabs 63 are then glued to appropriate surfaces to create the target manufactures as illustrated in FIGS. 1, 4–14 and 16–26.

Up to two optional reinforcements 64 may be added to pentahedral-comprised element 10 after the folding and gluing of the blank of FIG. 35 has been otherwise completed. Each reinforcement 64 being glued to three coplanar radial surfaces, one radial surface of each of three of the resulting pentahedral pyramids 12, providing otherwise unprovided webbing 44 for two more (a total of four more) of the resulting twelve edge sets 40. The remaining two unconnected edge sets 40 may be optionally glued along an inner portion of their length.

Up to twelve reinforcements 65 may be added to tetrahedral-comprised element 20 while the blank of FIG. 36 is being implemented. After being folded along its dashed line, each of these reinforcements 65 is glued to surfaces internal to the eight resulting tetrahedrons 22 along otherwise unconnected internal edge lines to provide additional support for otherwise unconnected intersecting surfaces which were further weakened by the provided slits 59. Once otherwise completed, the provided slits in any so constructed embodiments may be widened into slots to allow for the thickness of heavier sheet materials, or otherwise provided for with modifications to the basic blanks shown. In fact, if sheet metal, for example, were used to create larger embodiments, standard bend allowances, as appropriate for the materials in use, would have to be added to the patterns. Similarly, once otherwise completed, the outer vertices may be rounded and/or the slots/clefts tapered, as illustrated in FIG. 27, along the edge sets 40 to allow easier mating and assembly.

Figure 38C:
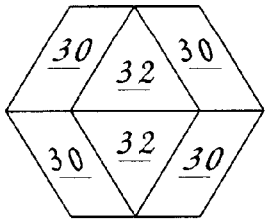
FIGS. 38*a*–38*c*, illustrate three views of a Non-Cuboctahedral Quadecahedron (14-faceted) Space Definition which provides the basis for the third embodiment 70.
Figure 38A:
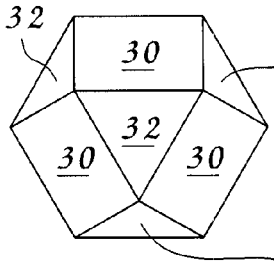
Figure 38B:
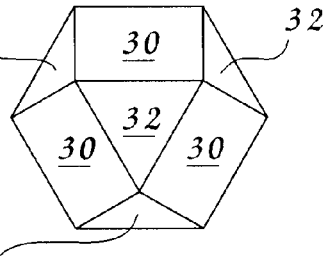

FIGS. 37*a*–37*c* illustrate a third embodiment of a combined element 70 of the invention. Combined element 70 has one half that is comprised of three physical pentahedral pyramids 12 and four spatial tetrahedral pyramids, and a second contiguous half that is comprised of four physical tetrahedral pyramids 22 and three spatial pentahedral pyramids. Thus, while conforming to the noncuboctahedral equilateral quadecahedron (14 faceted) space definition illustrated in FIGS. 38*a*–38*c*, combined element 70 may be interfitted with first element 10, second element 20, and/or additional embodiments of third element 70; and may be viewed as seven facet-based material pyramids (pyramidal members) and seven facet-based spatial pyramids (pyramidal recesses) providing for twelve difurcated edge sets which define and lie on seven mutually oblique and non-parallel planes which intersect at the element's central point.

FIG. 39 depicts a blank pattern used to create third embodiment combined element 70. Having portions of both of the blanks of FIGS. 35 and 36, the alphabetic gluing indices provided on the blank of FIG. 39 are also instructional for the use of the blanks of FIGS. 35 and 36. The lower case character indices indicate that the gluing surface is actually a corresponding location on the reverse (unprinted side) of the blank. Upper case indices indicate that the gluing surface is the location where the index character is actually printed (its obverse). In each case, an indexed tab 63 is mated with a location having the same but opposite case index character. For example, the reverse of tab "a" is glued to the obverse of location "A"; and the obverse of tab "S" is glued to the reverse of location "s". In each case, the tab is placed and glued along the side of the line that the location index indicates. The placement locations of the optional reinforcements 64,65 have not been indicated, but are left to the discretion of the user, one of the first reinforcement 64 and up to six of the second reinforcement 65 may be used. Although some variation is acceptable, implementing the indexed gluing steps alphabetically is recommended. However, two tabs 63 (or even three, if reinforcements 64, 65 are included) must at times be glued simultaneously. Once folded and glued in this manner, the blank of FIG. 39, comprised of 3 generally square panels and 28 generally equilateral triangular panels (or 3 square and 22 triangular panels distributed about a central hexagonal panel) further provided with a plurality of securing/gluing tabs, forms a spatially dichotomized noncuboctahedral quadecahedron which, when provided with difurcated edge sets by the provided slits/slots, forms third structural element 70.

Virtual embodiments of the current invention may be implemented, by those skilled in the art, through the use of standard general purpose computer hardware, such as, but not limited to, desktop or laptop personal computers, and one or more readily available 3D modeling and/or rendering software packages, such as, but not limited to, one of the software application packages using the ACIS 3D modeling kernel, such as VRCreator, Solid Edge, ASCI 3D Building Blox, or the like. These software packages used "for creating, modifying, and manipulating 3D objects" " . . . as geometric entities with mass properties, topology, and other physical attributes". (These quotes, and those used during this description of virtual embodiments, are from descriptions of, and the terminology used in connection with, the ACIS 3D modeling kernel.) Where deemed desirable, existing specialized systems designed to produce virtual environments and/or objects may be used. However, no special hardware or software packages are required to produce useable objects/embodiments or to render these virtual embodiments of the invention visible to the computer operator(s). Although the use of a stereo viewing system may enhance the experience and efficience of using these virtual embodiments, it would be optional. The hardware and software used to make use of these virtual objects/embodiments may be separate and distinct from those used to produce the virtual objects/embodiments. This is particularly true if one of several 3D modeling standards available to produce and transfer such objects, such as the ACIS standard SAT file format, is used, where the specifications of a specific object/embodiment are effected in a standard transferable form in a standard storage medium, allowing such objects/embodiments to be moved to/from, and used by/with, a variety of hardware and software configurations/applications. Such specifications may be alternately effected in proprietary forms and/or mediums when used to "interface . . . with manufacturing-related applications". The physical mediums and methods required to implement the virtual reality/environment required, and the physical methods required to produce/use virtual objects, in general, or the virtual embodiments of the current invention are thoroughly understood by those skilled in the arts of doing so. The processes used to produce virtual embodiments of the current invention are quite standard, however the objects produced by these processes in accordance with the specifications of the current invention are quite unique.

The minimal hardware requirements for producing and/or using such virtual embodiments would be:

1. at least one operator-to-computer interface,
   a. keyboard
   b. pointing device
   c. and/or the like
2. at least one central processing unit,
3. at least one data storage medium,
   a. fixed storage mediums
      i. RAM/ROM
      ii. fixed disk drive (optional)
      iii. and/or the like
   b. removable/transferable storage mediums (optional)
      i. magnetic media
      ii. optical media
      iii. and/or the like
4. at least one computer-to-operator interface device,
   a. standard computer monitor
   b. stereo viewer (optional)
   c. virtual reality helmet/visor (optional)
   d. and/or the like running computer software comprising: at least one software module designed to provide and control virtual objects in virtual realities, whereby/in these virtual construction elements may be manipulated and/or displayed by a computer operator, and optionally, at least one additional software module, whereby the manner in which said objects may be aligned, interfitted, and assembled into larger structures is further restricted by at least one software module which restricts the occupancy of any portion of said virtual reality by more than one portion of defined virtual matter.

The use and usefulness of the current invention as both a construction element and as a puzzlement is demonstrated in FIGS. 40 thru 47. It can be also seen in these drawings that each assemblage of the preferred embodiments creates, in itself, a new larger intercleavable building block which, as an assembly, or fused or blended into a single monoelement as illustrated in FIGS. 63*a*–67, may be viewed and used as an embodiment of the current invention, as a construction element of yet larger more complex structures. In this respect, it can be said that the manufactures of the current invention form, or can, or may form, self-similar or fractalized structures or manufactures. Again, such assemblages or fusions may be viewed as Macro manufactures, and therefore, as macro-embodiments of the current invention.

Figure 49:
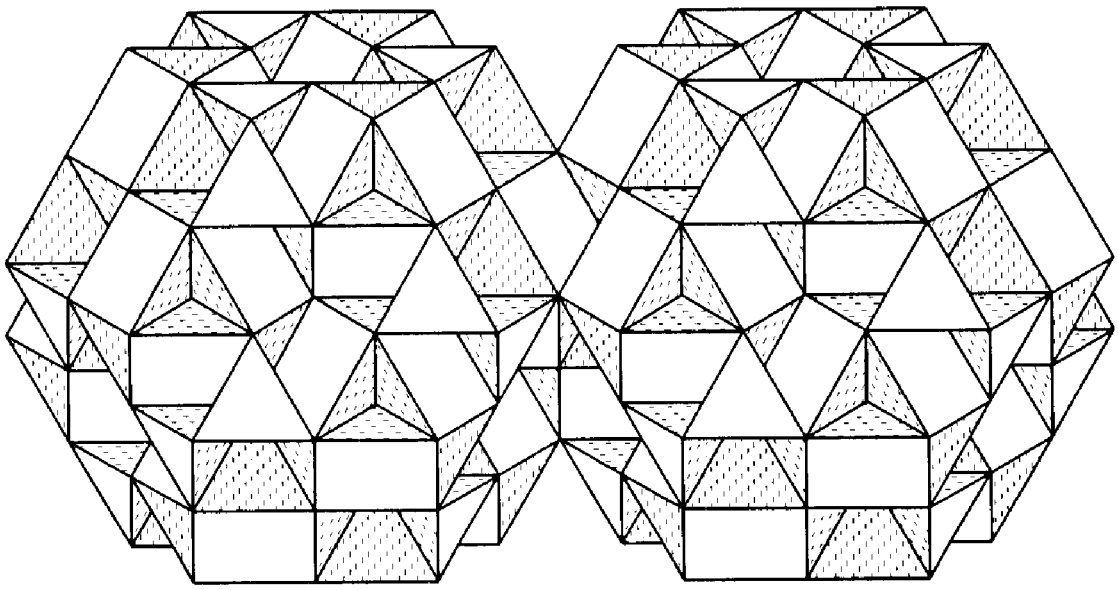
FIG. 49 illustrates two of the geodic assemblages of FIG. 48 interfitted as they function as fractalized intercleaving building blocks.

Even the geodic assembly of FIG. 48, comprised of twelve each of first element 10 and second element 20, is usable as an intercleaving building block to create even larger structures as illustrated in FIG. 49.

Figure 50A:
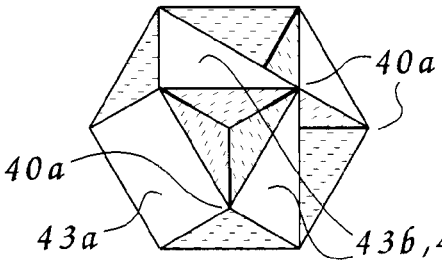
FIG. 50*a* thru FIG. 53*b* illustrate pairs of views of four examples of the further subdividing of the cuboctahedron space definition into additional embodiments of the current invention.

FIGS. 50*a* thru 53*b* illustrate how the basic use of a space definition can be further subdivided to define additional embodiments of this class of construction elements which is the current invention. In these cases, it is the cuboctahedron as employed by first element 10 and second element 20 which has been further subdivided. These embodiments also serve to further illustrate the three basic classes of edge sets, vertex-terminating 40*a*, edge-terminating 40*b*, and facet-terminating 40*c*. It can be seen that all edge sets 40 illustrated prior to FIG. 50*a* are, in fact, more specifically, vertex-terminating edge sets 40*a*.

Figure 50B:
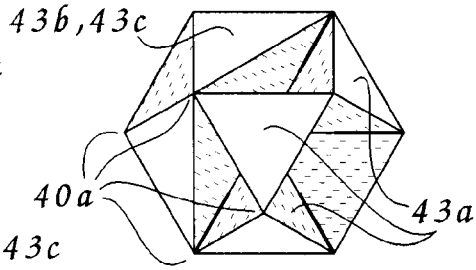
Figure 51A:
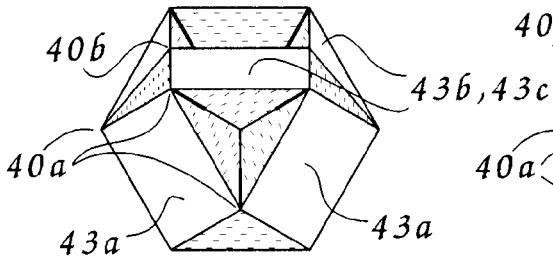
Figure 51B:
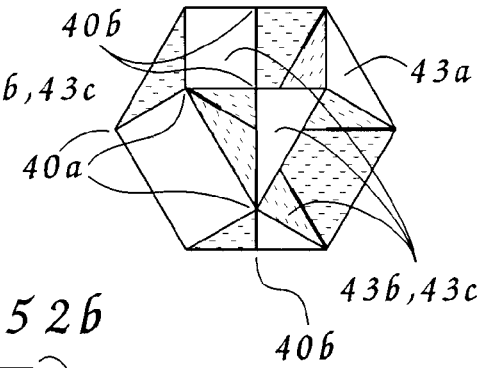

FIGS. 54*a* & 54*b* illustrate embodiments based on the projection of portions of the defining points of the cuboctahedral embodiment of FIGS. 50*a* & 50*b* into an octahedron space definition. Such basic embodiments, in addition to being projected, or partially projected, into other polyhedral space definitions, may be similarly projected into spherical or other ellipsoidal embodiments or into any other nonpolyhedral form or space definition.

FIGS. 68 and 69 depict spheroidal embodiments of the current invention 110 & 120 resulting from the effected projection of the cuboctahedron-based first and second preferred embodiments 10 and 20 into spheroidal forms. It can be seen in FIG. 71 that the essence of the underlying polyhedral elements remain in tact as their basic intercleaving nature and mating angles remain unchanged. The primary change is in their esthetics and the depth of their mutual penetration. FIG. 70 depicts a spherical embodiment 170 resulting from the projection of the third preferred embodiment 70 into a spheroidal form. It can be shown that these spheroidal embodiments can be implemented by, effectively, either extending the underlying polyhedral structure outward to a larger spheroid or truncating it to a smaller spheroid. One then need only adjust the depth of the edge set clefts for the desired effect. Either of these two forms of transformation used individually or in combination are collectively referred to herein as projections.

FIGS. 73 and 74 illustrate two spherically truncated embodiments 112 & 122 which have both been truncated by a larger spheroidal form encompassing and truncating portions of the entirety of the assembly depicted in FIGS. 45*a* and 45*b* to form the truncated assembly depicted in FIGS. 72*a*, 72*b*, and 72*c* These embodiments, despite their rounded surfaces, remain multi-faceted and also retain their basic intercleaving nature and mating angles defined by their underlying polyhedral definitions.

FIGS. 75*a* and 75*b* show the assemblage of first and second embodiments 10 & 20 depicted in FIGS. 45*a* and 45*b* after having been truncated by a circular toroid centered on and aligned with the assembly, forming the truncated embodiments 114 and 124 depicted in FIGS. 76 and 77. These two embodiments of the current invention 114 and 124 also retain the basic essence and function of the underlying embodiments 10 and 20. It can also be seen that any or all portions of any or all of the surfaces in FIGS. 75*a* and 75*b* which remain untruncated may be extended outward to conform to the limits of the toroid (or any other curved shape) without the underlying intercleaving construction elements losing their inherent function. Although many of the original construction elements' edge sets may be eliminated or shortened by this projection process, they retain their primary function within the assembly as long as sufficient number of edge sets retain their effectiveness. In FIG. 78 an un-truncated portion 116 of the embodiment of FIG. 76 is extended to the toroid's surface forming a continuous curved surface 118. This continuous curved surface is further extended in FIG. 79 when two of its recesses/voids are filled and projected to the toroid's surface.

While such projections of individual or collective/assembled embodiments of the are anticipated, the specific shape and attributes of embodiments resulting from specific projections are not; and the development of such uses, enhancements/improvements, and/or extensions of the current invention are encouraged.

Similarly, it can be seen that any sculpting of surfaces, edges, or the general shape of an embodiment which leaves a significant portion of the embodiments function in tact does not exclude a resulting embodiment from the scope of the current invention.

It should also be noted that once polyhedral embodiments are effectively projected (extended/truncated) into spherical, ellipsoidal or other curved/rounded embodiments, any affected vertex-terminating, edge-terminating, or facet-terminating edge sets would then peripherally terminate along the discontinuous curved surfaces of those embodiments; and such edge set termination designations would then be referring to vertices, edges, and/or facets of the underlying polyhedral form which defined the relative positions and orientations of those edge sets. However, it can be further seen that any edge set terminating at a convex peak of such curved surfaces is also enables such an embodiment to penetrate into the body of complementarily formed embodiments.

FIGS. 50*a* thru 56*b* and 59*a* thru 60*c* also demonstrate the more general definition of a facet-base pyramid. While all of the embodiments depicted prior to FIG. 50*a* are comprised only of full-facet-based pyramidal members and recesses (where an entire facet of the construction element's polyhedral base acts as the base of the corresponding pyramidal member) many embodiments of the current invention may also (or solely) comprise semi-facet-based pyramidal members an/or recesses, where only a portion/subdivision of the facet of the element's polyhedral base acts as the pyramid's base. The prefix "semi" is being used here to mean, more generally, "partly, not fully" rather than strictly as "half", and the term "half-facet-based" is used to designate the more specific case where half of the element's polyhedral base acts as the pyramid's base. The distinctions between some of these full-facet-based 43*a*, semi-facet-based 43*b*, and half-facet-based 43*c* pyramidal members are designated in FIGS. 50*a* thru 56*b* and 59*a* thru 60*c*. The generalized term "facet-based" is inclusive of any or all of the three preceding more specific terms.

FIG. 55 illustrates the most basic octahedral based embodiment of the current invention, where each facet of a polyhedral space definition is viewed as the base of a pyramid whose summit/apex lies at the center of the space definition. These comprising pyramidal members are then alternately defined as either material or spatial. The original polyhedral whole may now be viewed as having been dichotomized into material and spatial elements. The resulting edge sets are then difurcated as earlier described for first element 10 and second element 20. This may be viewed as a first-order embodiment of the current invention based on a first-order dichotomization (spatial dichotomization) of a defined polyhedral object and/or space definition.

FIGS. 56*a* & 56*b* illustrate embodiments derived by further subdividing an octahedron space definition into polyhedral elements which extend to the center of the space definition.

Figure 52A:
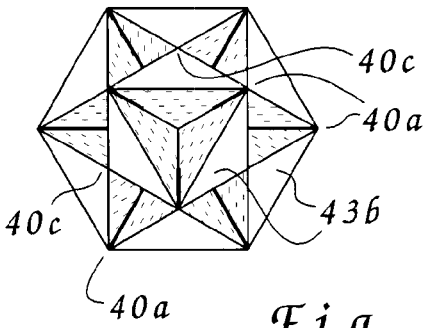
Figure 52B:
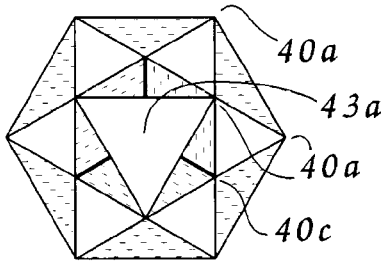
Figure 53A:
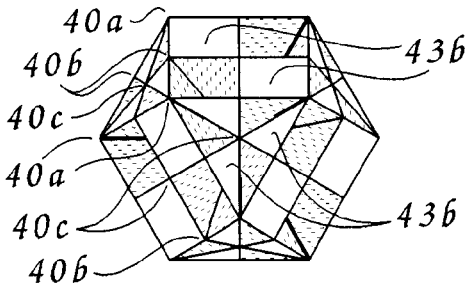
Figure 53B:
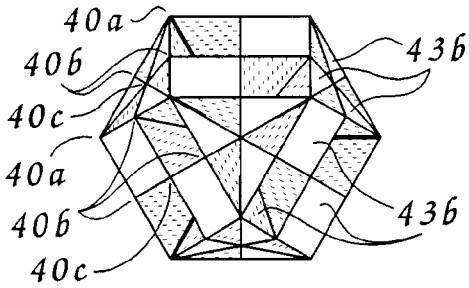
Figure 59B:
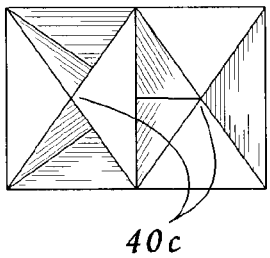
FIGS. 59*a* thru 59*c* illustrate three views of an Intercleaving Building Block based on a cubic (hexahedron) space definition.
Figure 59A:
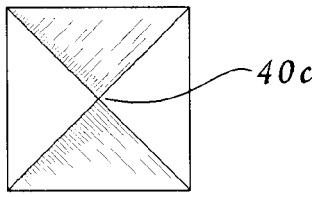
Figure 59C:
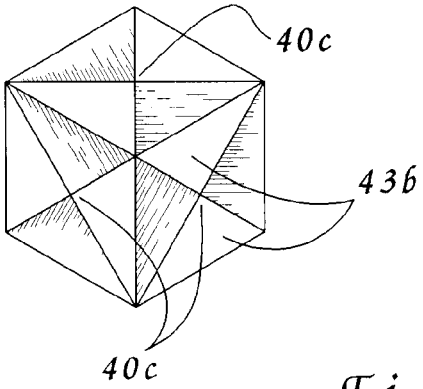

This may be viewed as a fifth-order embodiment of the current invention in that it may be viewed as having been formed by starting with the first-order embodiment of FIG. 55 and then, four times, dividing it into two sections and spatially inverting one of those two sections; with spatial inversion being the conversion of spatial elements into material elements while simultaneously converting material elements into spatial elements. Each successive cycle/phase of division and spatial inversion can be viewed as an additional level or order of dichotomization, spatial inversion, or spatial dichotomization. With this in mind, we may now classify the first, second, and third embodiments (10, 20, and 70, respectively) as first-order embodiments, while the two embodiments depicted in FIGS. 50*a* & *b* and 51*a* & *b* are second-order embodiments. FIGS. 52*a* & *b* present two views of a fourth-order cuboctahedron based embodiment; and FIGS. 53*a* & *b* are two views of a seventh-order cuboctahedral embodiment of the current invention. These embodiments may also be viewed as resulting from second, fourth, and seventh-order spatial dichotomizations of a cuboctahedron who's resulting edgesets are subsequently difurcated. As an extension of the second-order embodiment of FIGS. 50*a* & 50*b*, that of FIGS. 54*a* & *b* may also be classified as a second-order embodiment.

Just as the five first-order embodiments depicted in FIGS. 57*a* thru 57*e* have not been uniformly dichotomized, subsequent dichotomizations need not be evenly distributed nor applied to the entirety of the manufacture, but may be applied to any number of or a single element of the previously defined embodiment. Similarly, subsequent dichotomizations need not be based on binary or centered divisions of the space definition, but may be the result of off-centered divisions, or multiple divisions to which spatial inversion is alternately applied.

These icosahedron based embodiments depicted in FIGS. 57*a* thru 57*e* also serve to illustrate the more general definitions of several terms used throughout this document. We first define a peripheral surface or facet of a comprising polyhedral element/formation as any of its surfaces which coincides with, forms, or is generally aligned with a portion of one of the peripheral surfaces of the manufacture as a whole and/or the periphery of any confining space definition, and which do not radiate outward from the center of the manufacture. The periphery of the manufacture would include the resulting truncations of the vertices or edges of its primary form once projected/truncated/extended into a secondary form space definition. For example, the base of a facet-based pyramid would also be referred to as a peripheral facet/surface of that pyramid as well as a peripheral facet/surface of the manufacture (structural/construction element) itself. Similarly, the sides of that facet-based pyramid, which radiate inward toward its apex, centrally located within the manufactures general form, would also be referred to as radial facets/surfaces of both the pyramidal formation/element and of the manufacture as a whole, since those facets/surfaces radiate from the manufactures core toward/to its peripheral surface(s).

In the case of FIG. 57*a*, the surfaces indexed as A thru G identify seven of the peripheral facets of the depicted icosahedron based manufacture/embodiment as well as the seven underlying material tetrahedral elements of the manufacture. (For simplicity, we are here ignoring those tetrahedral elements whose peripheral surfaces are not visible in these views.) Each of these same seven surfaces is also individually referred to as the peripheral facet or surface of each of the corresponding tetrahedral/pyramidal elements of the embodiment. Furthermore, with the peripheral facets of these tetrahedrons designated as the bases of their pyramidal forms, they also become defined as facet-based material pyramids.

In the embodiments of FIGS. 57*b* thru 57*e* the depicted sets of material tetrahedrons are subsets of the set of tetrahedrons depicted in FIG. 57*a*, where one or more of the seven material tetrahedral pyramids have been converted to spatial elements; i.e. removed or spatially inverted, which may also be now referred to as facet-based spatial pyramids, or pyramidal recesses/voids.

These seven tetrahedral elements of FIG. 57*a* may also be viewed as forming at least two complex composite polyhedrons composed of facially adjacent tetrahedral pyramids. That is to say that facially adjacent tetrahedral elements A and B may also be viewed as composite polyhedron AB. Tetrahedrons A and B are said to be facially adjacent because they each have a facet which shares a common and, in this case, coincident planar space with the other. Similarly, the continuous string (continuum) of facially adjacent tetrahedrons C through G may be viewed as the complex polyhedron CDEFG; or as any of several sets of smaller composite polyhedra such as (CD, EF, & G); (CDE & FG); & (DEFG); (CD, E, FG); etc. In this sense, a fully physical icosahedron can be viewed as a cluster or closed continuum of twenty facially adjacent tetrahedrons where each tetrahedron is facially adjacent to three surrounding tetrahedrons; and any subset of facially adjacent tetrahedral pyramids may be viewed as a polyhedral element of the icosahedral whole.

If any individual element or set of these tetrahedral elements of the whole are removed and thereby converted to space, bounded by the remaining physical polyhedral elements, they may be similarly viewed as being spatial elements of this new whole. In FIGS. 57*a* and 57*b*, the spiritual elements bounded by physical elements A, C, & F and A, C, E, & G respectively can be referred to as spatial elements acf and aceg respectively.

These spatial elements may each be alternately, and more specifically, referred to as a continuum of apex-coincident, facially adjacent, facet-based pyramidal recessions or voids, or facet-based spatial pyramids. Similarly, the continuous structures formed by these tetrahedral elements may each be more specifically referred to as a continuum of apex-coincident, facially adjacent, facet-based material pyramids or pyramidal formations/elements. Any continuum of material pyramids or individual pyramidal member of a material continuum which protrudes sufficiently to allow it to participate in the formation of an edge set may also be referred to as a structural member comprised by the manufacture.

The term diagonally adjacent polyhedrons, or more specifically, diagonally adjacent pyramids is also illustrated here most simply in FIG. 57*e* where tetrahedral pyramids A, C, and F are each diagonally adjacent to the other two across their common edge lines collectively referred to as an edge set, in this case edge set ACF. Again, each tetrahedron can be viewed separately or as a portion of a more complex polyhedron or of a continuum of tetrahedral pyramids. Therefore, in FIG. 57*a*, individual tetrahedron C can be viewed as being diagonally adjacent to tetrahedrons A and B individually or diagonally adjacent to the compound polyhedron AB across edge set ABC. Similarly, polyhedron AB may be viewed as being diagonally adjacent to compound polyhedron CDEFG at two points, across edge sets ABC and AFG. Similar to FIG. 57*e*, in FIG. 57*c*, compound polyhedrons AB, CD, and FG are each diagonally adjacent to the other two. In FIG. 57*b*, polyhedron CDE is diagonally adjacent to both G and AB, while G is also diagonally adjacent to AB.

The resulting edge sets visible in the dichotomized polyhedra of FIGS. 57*a, b*, & *c* have not been difurcated and would, therefore, not qualify as being intercleaving, as defined herein, unless one or more of their edge sets were in fact difurcated.

In FIG. 57*d* it can be seen that regardless of how one chooses to view elements F and G, element A has been separated, i.e. difurcated, from both F and G individually and as the composite element FG, producing what is herein referred to as a difurcated edge set. A more generalized example of difurcated edge sets can be seen in FIGS. 52*a* and 56*a* where edge sets formed by at least three diagonally adjacent material elements have been difurcated, separating each of the elements from each of the others.

Figure 60B:
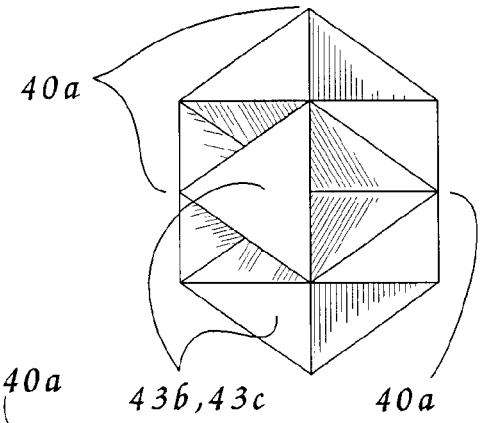
FIGS. 60*a* thru 60*c* illustrate three views of an Intercleaving Building Block based on a rhombic dodecahedron space definition, which may be also viewed as an extension from the embodiment of FIGS. 59*a* thru 59*c* into a rhombic dodecahedron space definition.
Figure 60A:
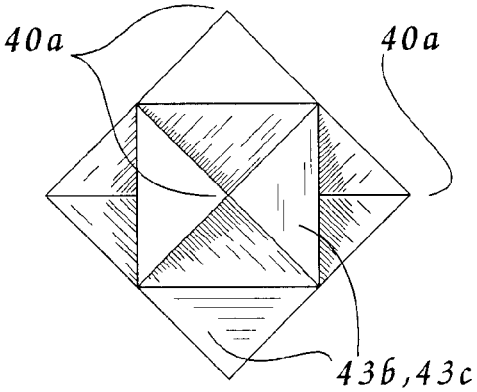
Figure 60C:
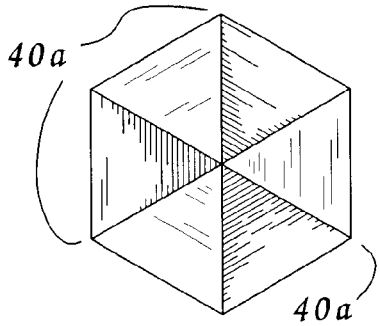

FIGS. 58*a* thru 58*c* provide three different views of a first-order quindecahedron based embodiment of the current invention. FIGS. 59*a* thru 60*c* provide three views of each of two seventh-order embodiments based on: 1) a cube space definition (FIGS. 59*a–c*); and 2) a rhombic dodecahedron space definition (FIGS. 60*a–c*). The latter may also be viewed as a projection of the cubic embodiment of FIGS. 59*a* thru 59*c* into the rhombic dodecahedron space definition.

Figure 61:
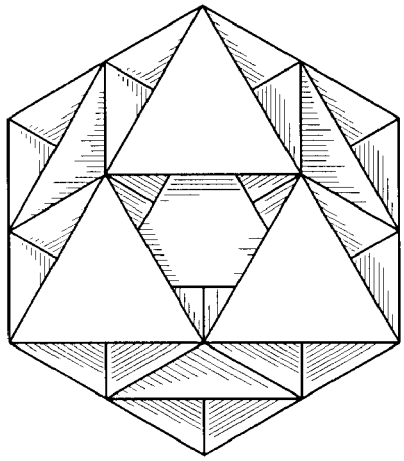
FIG. 61 illustrates a fractalized octahedral assemblage of seven of the first-order octahedral embodiment depicted in FIG. 55.
Figure 62:
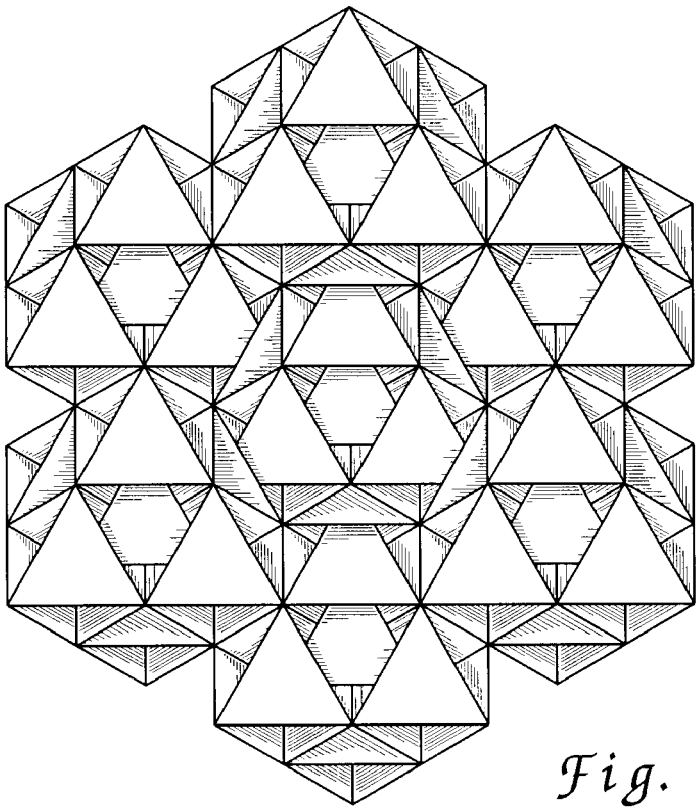
FIG. 62 illustrates a fractalized octahedral assemblage of seven of the seven-element octahedral macro-embodiment depicted in FIG. 61.

FIGS. 61 and 62 depict successively fractalized assemblages of the first-order octahedral embodiment presented in FIG. 55. FIG. 61 is the result of six of these FIG. 55 embodiments being mated with a centering seventh along its six difurcated edge sets. Similarly, the structure of FIG. 62 is formed when six FIG. 61 macro-embodiments are mated with the six exposed edge sets of a seventh FIG. 61 embodiment.

Figure 40:
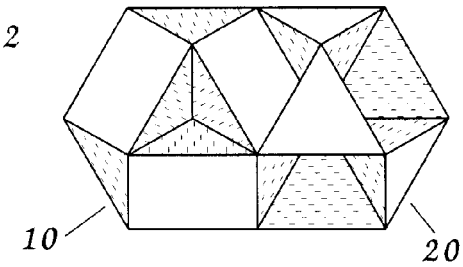
FIG. 40 illustrates a reduced-size perspective view taken from FIG. 1 of structural elements 10 and 20 of the first and second embodiments, respectively, fully mated
Figure 41A:
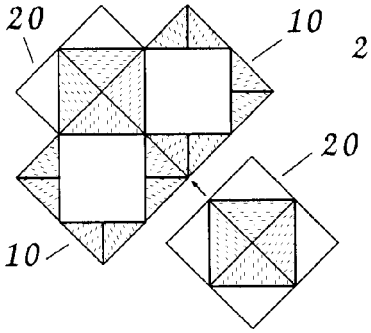
FIG. 41*a* illustrates a plan view of an assembly of three structural elements 10, 20, prior to the addition of a fourth tetrahedral-comprised structural element 20 to the assembly.
Figure 43A:
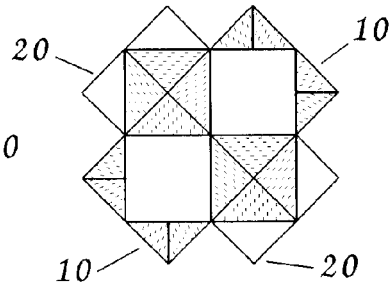
FIG. 43*a* illustrates a plan view of a fourth structural element 20 added to the assembly of FIG. 41*a*.
Figure 42A:
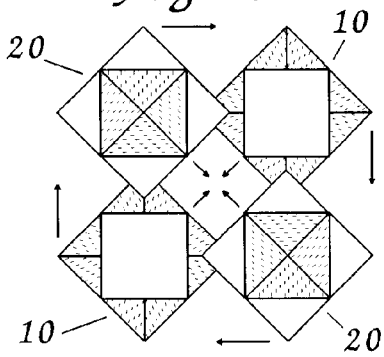
FIG. 42*a* illustrates a plan view of the assembly process for adding an element 20 to the assembly of FIG. 41*a*.
Figure 41B:
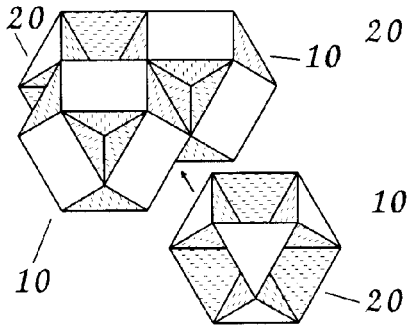
FIG. 41*b* illustrates a perspective view of the assembly and element 20 of FIG. 41*a*.
Figure 43B:
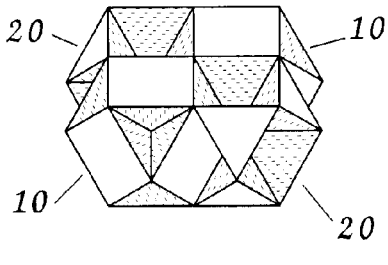
FIG. 43*b* illustrates a perspective view of the assembly of FIG. 43*a*.
Figure 42B:
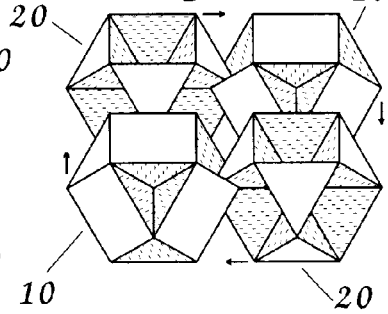
FIG. 42*b* illustrates a perspective view of the assembly method of FIG. 42*a*.

FIG. 63*a* illustrates an embodiment based upon fusing the assembly illustrated in FIG. 40, comprised of a first embodiment element 10 interfitted with a second embodiment element 20, which are fused together to form a single contiguous fused element 130. The fused element 130 includes a combination of a first element 10 and a second element 20, but two of the voids of the second embodiment element 20 portion of fused element 130 have been optionally filled, but still leave element 130 with a number of difurcated edge sets capable of intercleaving with additional elements of the invention, as set forth above. FIG. 63*b* illustrates a reverse-side view of fused element 130 rotated approximately 120 degrees. FIG. 63*c* illustrates a bottom view of fused element 130.

FIGS. 64 thru 67 illustrate additional fused embodiments which may be constructed in accordance with the present invention. FIG. 64 illustrates an embodiment based on a fusing of three first embodiment elements 10 with a single centrally-located second embodiment element 20. FIG. 65 illustrates an embodiment based on the fusing of three second embodiment elements 20 with a single centrally-located first embodiment element 10.

FIG. 66 illustrates the embodiment of FIG. 64 with the tetrahedral voids filled in. FIG. 67 illustrates the embodiment of FIG. 65 with the central tetrahedral void filled in. It will be apparent that a variety of other fused elements may also be constructed based on the structural elements of the invention.

The embodiments of FIGS. 63*b* thru 65 and most obviously in FIGS. 66 and 67 may also be viewed as construction elements comprising intercleaving spatially dichotomized multifaceted protrusions, or in other words, protrusions which have been individually and/or collectively formed/modified to comply with the teachings and specifications of the current invention.

In more general discussion, if molded of appropriate materials (including recycled plastics) and in appropriate sizes, various embodiments of the current invention can be used as decorative construction blocks. They can be assembled to function as lawn furnishings, sculptures, climbing structures and play houses, planters and trellises, or as privacy or retaining walls, including unique outdoor staircases which might double as retaining walls.

Their intercleaving nature will make them particularly suitable for constructing large retaining or sea walls. A variety of manufacture and assembly techniques can be employed. to create unique wave dampening systems/structures, and artificial reefs. These aquatic uses might be most effective if implemented with elements which are at least partially hollowed and provided with appropriately sized portals to control wave and tidal induced water flows, as well as to function as homes and sheltered hatcheries for small to medium sized aquatic life. Geodic assemblies may be useful not only in such aquatic shelters, but also in industrial settings as containment chambers or bunkers.

Constructed of appropriate materials (steel, aluminum, industrial plastics, epoxy /fiber composites, etc.) and in appropriate sizes, these structures may also function as a connection system for structural members/beams. The structural members (rods, I-beams, trusses, etc.) may be attached to a portion of one or more of the outer surfaces of the structures and/or the structures attached to each end of the members. The members may also be extensions of the outer surface of one or more of the physical or spatial polyhedrons. In the latter case, the beam would extend into and fill the spatial polyhedron and, in effect, be permanently attached. Additional threaded or unthreaded receptacles/openings may also be provided to allow for a more permanent assembly of structures via bolts or rivets, or they may simply be bonded by welds or adhesives. The interfitting nature of these structures will allow the beams to self-align and hold themselves in place while construction crews or do-it-yourselfers complete the assembly and/or the adhesives harden/cure. The manner in which the surfaces of the intercleaving structures interface make these structures particularly effective in amplifying the strength of adhesive bondings.

Rather than having the structural members attached directly to the surfaces of these structures, receptacles may be machined or molded into these surfaces to receive the members. The spatial polyhedrons formed within the basic embodiments may also be used, with or without modifications, as Structural Member receptacles. Manufactured from appropriate materials they may be used for heavy "or light weight real-world construction, or in a recreational construction set. In such construction sets, the basic embodiments would not only serve to interconnect the rods, but would also be able to interact with each other.

In any of the aforementioned real construction systems/uses, care must be taken to provide more than adequate webbing, central point, and reinforcement material to insure structural integrity above and beyond the intended use. Although any stipulated use of mortar or other adhesive or connective systems (collectively referred to here as mortared) would greatly increase the strength of assembled structures, there would be, due to their basic nature, a tendency by end users to use such blocks or construction members in a mortarless manner. In such mortarless assemblies, no matter how tightly fitted and mutually supportive the discrete intercleaving components may be, their primary weakness will, of course, lie along their difurcated edge sets. This weakness is further amplified by the relatively high moments of inertia about these edge sets and their coincident central points due to the inverted pyramidal masses of their comprising polyhedral elements, relative to their coincident central points. These inertial moments may be reduced by making the outermost portions of the polyhedral elements hollow or comprised of light weight aggregates, foam or honeycombed structures. In any case, the final design of discrete components should, both individually and in mortared or unmortared compiled assemblies, be as capable or more capable of enduring the abnormal G forces associated with earth tremors, quakes, or abnormal tidal effects, or waves, as any comparable mortared construction system.

Elements of differing sizes may be interconnected to represent different elements in molecular and crystal models, or to simply allow greater artistic and structural variety in general recreational and construction applications. Individual structures, with or without the interfacing features, and simulated or permanently assembled combinations of structures may also be produced as stand-alone decorative and/or functional products. Such products might include nicknacks, paperweights, ash trays, candle holders/lamps, bookends, Christmas tree ornaments, candy dishes, and trinket boxes. Larger items might include coffee and end tables, magazine racks, stools, benches, lamps, and ottomans. Thus, while preferred embodiments have been described herein, it will be recognized that a variety of changes and modifications may be made without departing from the spirit of the subject invention.

What is claimed is:

1. Generally polyhedral construction elements comprising
- a polyhedral body, within which
  - a plurality of diagonally adjacent facet-based pyramidal recesses are formed, further forming
  - a plurality of diagonally adjacent facet-based pyramidal members, and
  - a plurality of difurcated edge sets, where
    - said difurcated edge sets each comprise
      - a plurality of coincident edges of diagonally adjacent facet-based pyramidal members,
      - a plurality of coincident edges of diagonally adjacent facet-based pyramidal recesses interspersed among said diagonally adjacent pyramidal members, and
      - a cleft implemented along an outermost portion of said coincident edges of said diagonally adjacent members, separating a corresponding portion of at least one of said members from the remaining diagonally adjacent member(s), and where
  - each of said difurcated edge sets enables the interfitting of a first said construction element along said edge set with at least a second said construction element having a substantially complementarily formed and difurcated edge set; whereby
  - the body of said first construction element penetrates into the body of said second construction element and the body of said second construction element simultaneously penetrates into the body of said first construction element in a mutually intercleaving, mutually interpenetrating manner.

2. Generally polyhedral construction elements of claim 1 where each of the recesses in at least one set of said diagonally adjacent facet-based pyramidal recesses is a full-facet-based pyramidal recess each an effected recession of one of the facets of said polyhedral body inward toward a central point of the construction element, where
- said polyhedral body's facet and said central point serves as the base and apex,
  - respectively, of said facet-based pyramidal recess, and where each of the members in at least one set of said diagonally adjacent facet-based pyramidal members is a full-facet-based pyramidal member each an effected extension of one of the facets of said polyhedral body inward toward a central point of the construction element, where
- said polyhedral body's facet and said central point serves as the base and apex,
  - respectively, of said facet-based pyramidal member.

3. Generally polyhedral construction elements of claim 1 where
- each of the recesses in at least one set of said diagonally adjacent facet-based pyramidal recesses is a half-facet-based pyramidal recess each an effected recession of one half of one of the facets of said polyhedral body inward toward a central point of the construction element, where
  - said one half of said polyhedral body's facet and said central point serves as the base and apex, respectively, of said half-facet-based pyramidal recess, and where
- each of the members in at least one set of said diagonally adjacent facet-based pyramidal members is a half-facet-based pyramidal member each an effected extension of one half of one of the facets of said polyhedral body inward toward a central point of the construction element, where said one half of said polyhedral body's facet and said central point serves as the base and apex, respectively, of said half-facet-based pyramidal member.

4. Generally polyhedral construction elements of claim 1 further limited to construction elements wherein at least one of said plurality of recesses is a continuum of facially adjacent facet-based pyramidal recesses, wherein no two facially adjacent pyramidal recesses of said continuum of facially adjacent facet-based pyramidal recesses have coplanar bases, and at least one of said plurality of members is a continuum of facially adjacent facet-based based pyramidal members, wherein no two facially adjacent pyramidal members of said continuum of facially adjacent facet-based pyramidal members have coplanar bases.

5. The construction elements cited in claim 1 wherein at least one of said at least one difurcated edge sets is a vertex-terminating edge set, radiating inward from a vertex of said polyhedral body.

6. The construction elements cited in claim 1 wherein at least one of said difurcated edge sets is non-coplanar with and nonparallel to the shared plane of at least one co-planar pair of said difurcated edge sets.

7. The construction elements cited in claim 1 wherein said polyhedral members of said sets of diagonally adjacent polyhedral members are interconnected along an innermost portion of the length of said formed edge sets by webbing, and where said polyhedral members of at least one set of said interconnected diagonally adjacent polyhedral members are difurcated along an outermost portion of the length of said formed edge set by at least one slot, thereby forming at least one difurcated edge set.

8. The construction elements cited in claim 1 wherein said polyhedral members of said sets of diagonally adjacent polyhedral members are interconnected along an innermost portion of the length of said formed edge sets by webbing, and where said polyhedral members of at least one set of said interconnected diagonally adjacent polyhedral members is provided with a provisional difurcation along an outermost portion of the length of said formed edge set.

9. The construction elements cited in claim 1 wherein said polyhedral members of at least one of said at least one set of diagonally adjacent polyhedral members are interconnected along an innermost portion of the length of said formed edge set by webbing, and where said polyhedral members of said at least one set of interconnected diagonally adjacent polyhedral members is provided with a provisional difurcation along an outermost portion of the length of said formed edge set, thereby forming at least one provisionally difurcated edge set, where said at least one provisional difurcation is implemented as noticeably thinner webbing, whereby at least one slot may be, at a later time, readily implemented between at least one pair of said diagonally adjacent polyhedral members, whereby said at least one difurcated edge set is facilitated, and thereby indirectly and/or cooperatively implemented.

10. The construction elements cited in claim 1 where said generally polyhedral base is further limited to a convex polyhedral base/body.

11. The construction elements cited in claim 1 where said generally polyhedral base is further limited to a spherically symmetrical polyhedral base/body.

12. The construction elements cited in claim 1 where said generally polyhedral base is further limited to a generally nonprismatic polyhedral base/body.

13. The construction elements of claim 1 wherein said construction elements have a generally polyhedral base/body chosen from the set consisting of cuboids, octahedrons, dodecahedrons (including rhombic dodecahedrons), guadecahedrons (including cuboctahedrons), quindecahedrons, and icosahedrons.

14. The construction elements cited in claim 1 further defined by an effected projection of at least a portion of the peripheral points and surfaces of said construction elements to the surface(s) of a second geometric form.

15. The construction elements cited in claim 1 further defined by an effected projection of at least a portion of the peripheral points and surfaces of said construction elements to the form of a convex polyhedron.

16. The construction elements cited in claim 1 further defined by an effected projection of at least a portion of the peripheral points and surfaces of said construction elements to the form of an ellipsoid, where ellipsoids are inclusive of spheres and other spheroids.

17. Construction elements comprising a plurality of generally polyhedral members formed and arranged fully within the confines of, and generally conforming to the shape of, a polyhedral base in a manner whereby:

at least one set of at least two diagonally adjacent polyhedral members is formed, where at least one facet of at least one member of at least one of said at least one set of diagonally adjacent polyhedral members is coplanar with, and coincident with at least a portion of one of the facets of said polyhedral base, and where at least one vertex of said facet of at least one of said member is coincident with a vertex of said facet of said polyhedral base, wherein an edge set is formed along the coincident edges of said diagonally adjacent polyhedral members of each of said at least one set of diagonally adjacent polyhedral members, and wherein a plurality of polyhedral voids are formed by and interspersed among said polyhedral members in a manner whereby at least two diagonally adjacent polyhedral voids are formed about each edge set formed by said at least one set of diagonally adjacent polyhedral members, and wherein said polyhedral members of at least one of said at least one set of diagonally adjacent polyhedral members are interconnected along an innermost portion of the length of said formed edge set and where said polyhedral members of said at least one set of interconnected diagonally adjacent polyhedral members are difurcated along an outermost portion of the length of said formed edge set, thereby forming at least one difurcated edge set, where at least one of said at least one difurcated edge set radiates inward from a point along an edge of said polyhedral base, where said edge of said polyhedral base is inclusive of the two vertices of said polyhedral base which define said edge, whereby said at least one difurcated edge set enables the interfitting of a first said construction element along said edge set with at least a second said construction element having a substantially complementarily formed and difurcated edge set; whereby the body of said first construction element penetrates into the body of said second construction element and the body of said second construction element simultaneously penetrates into the body of said first construction element in a mutually intercleaving, mutually interpenetrating, and mutually supporting manner, whereby the construction of intercleaving assemblages of said construction elements is facilitated, and where said polyhedral base is said to provide the basis of a generally polyhedral body for said construction element, and where said interfitting of said complimentary construction elements is enabled by the aforementioned formations fully implemented within the confines of said polyhedral body, said interfitting is thereby fully enabled without an attachment of appendages to said polyhedral body.

18. The construction elements cited in claim 17 wherein at least one of said at least one difurcated edge sets is a vertex-terminating edge set, radiating inward from a vertex of said polyhedral body.

19. The construction elements cited in claim 17 wherein at least one of said difurcated edge sets is obliquely noncoplanar with and nonparallel to the shared plane of at least one co-planar pair of said difurcated edge sets.

20. The construction elements cited in claim 17 wherein said polyhedral members of said sets of diagonally adjacent polyhedral members are interconnected along an innermost portion of the length of said formed edge sets by webbing, and where said polyhedral members of at least one set of said interconnected diagonally adjacent polyhedral members are difurcated along an outermost portion of the length of said formed edge set by at least one slot, thereby forming at least one difurcated edge set.

21. The construction elements cited in claim 17 wherein said polyhedral members of said sets of diagonally adjacent polyhedral members are interconnected along an innermost portion of the length of said formed edge sets by webbing, and where said polyhedral members of at least one set of said interconnected diagonally adjacent polyhedral members is provided with a provisional difurcation along an outermost portion of the length of said formed edge set.

22. The construction elements cited in claim 17 wherein said polyhedral members of at least one of said at least one set of diagonally adjacent polyhedral members are interconnected along an innermost portion of the length of said formed edge set by webbing, and where said polyhedral members of said at least one set of interconnected diagonally adjacent polyhedral members is provided with a provisional difurcation along an outermost portion of the length of said formed edge set, thereby forming at least one provisionally difurcated edge set, where said at least one provisional difurcation is implemented as noticeably thinner webbing, whereby at least one slot may be, at a later time, readily implemented between at least one pair of said diagonally adjacent polyhedral members, whereby said at least one difurcated edge set is facilitated, and thereby indirectly and/or cooperatively implemented.

23. The construction elements cited in claim 17 where said generally polyhedral base is further limited to a convex polyhedral base/body.

24. The construction elements cited in claim 17 where said generally polyhedral base is further limited to a spherically symmetrical polyhedral base/body.

25. The construction elements cited in claim 17 where said generally polyhedral base is further limited to a generally nonprismatic polyhedral base/body.

26. The construction elements of claim 17 wherein said construction elements have a generally polyhedral base/body chosen from the set consisting of cuboids, octahedrons, dodecahedrons (including rhombic dodecahedrons), guadecahedrons (including cuboctahedrons), quindecahedrons, and icosahedrons.

27. The construction elements cited in claim 17 further defined by an effected projection of at least a portion of the peripheral points and surfaces of said construction elements to the surface(s) of a second geometric form.

28. The construction elements cited in claim 17 further defined by an effected projection of at least a portion of the peripheral points and surfaces of said construction elements to the form of a convex polyhedron.

29. The construction elements cited in claim 17 further defined by an effected projection of at least a portion of the peripheral points and surfaces of said construction elements to the form of an ellipsoid, where ellipsoids are inclusive of spheres and other spheroids.

30. The construction elements of claim 1 wherein said pyramidal facet-based members are limited to physical facet-based pyramidal members.

31. The construction elements of claim 17 wherein said pyramidal members are limited to physical pyramidal members.

32. Construction elements of claim 1 comprising the functional equivalent of a fused plurality of interfitted construction elements, where each of said plurality of construction elements is individually a construction element as defined in claim 1, and where at least one generally convex protrusion is formed, wherein at least one of said difurcated edge sets is formed radiating inward from a vertex of said protrusion.

33. Construction elements of claim 1 comprising the functional equivalent of a fused plurality of interfitted construction elements, where each of said plurality of construction elements is individually a construction element as defined in claim 1 based in a convex polyhedral base, and where at least one of said plurality of elements forms a generally convex protrusion, where each of said protrusions comprises at least one of said difurcated edge sets radiating inward from a vertex of said protrusion.

34. The construction elements of claim 33 wherein at least one of said plurality of construction elements has been further defined by the effected projection of at least a portion of its peripheral points and surfaces into the form of a section of a spheroid.

35. The construction elements of claim 1 further limited to construction elements produced in a virtual reality provided by a virtual medium for computer manipulation and display, where said virtual medium is physically provided in the form of a general purpose computer hardware system running computer software comprising at least one software module designed to provide and control the objects within virtual realities, such as said virtual reality, whereby said manipulation and display of elements of said virtual reality, such as said construction elements, by a computer operator, are facilitated, and where the specifications of said claims are effected in a standard form in a standard storage medium, where said polyhedral members of said construction elements are formed as virtual matter in accordance with the specifications of said claims, and wherein said polyhedral voids are interspersed among and defined by said virtual matter within said base/body.

36. The construction elements of claim 35 where said computer hardware system had been specifically designed to provide and control virtual realities, such as said virtual reality.

37. The construction elements of claim 35 where said computer hardware system comprises at least one operator-to-computer interface, at least one central processing unit, at least one data storage medium, and at least one computer-to-operator interface device, where said computer-to-operator interfaces are inclusive of a computer monitor.

38. The construction elements of claim 35 where said at least one computer-to-operator interface device comprises at least one stereo viewing system.

39. The construction elements of claim 35 where the manner in which said construction elements may be aligned, interfitted, and assembled into larger structures is further restricted by at least one software module which restricts the occupancy of any portion of said virtual reality by more than one portion of defined virtual matter.

40. Generally polyhedral construction elements of claim 1 where each of the recesses in at least one set of said diagonally adjacent facet-based pyramidal recesses is a semi-facet-based pyramidal recess each an effected recession of a polygonal portion of one of the facets of said polyhedral body inward toward a central point of the construction element, where said polygonal portion of said polyhedral body's facet and said central point serves as the base and apex, respectively, of said semi-facet-based pyramidal recess, and where each of the members in at least one set of said diagonally adjacent facet-based pyramidal members is a semi-facet-based pyramidal member each an effected extension of a polygonal portion of one of the facets of said polyhedral body inward toward a central point of the construction element, where said polygonal portion of said polyhedral body's facet and said central point serves as the base and apex, respectively, of said semi-facet-based pyramidal member.

41. Generally polyhedral construction elements of claim 1 wherein the apexes of all said facet-based pyramidal recesses and of all said facet-based pyramidal members are coincident.

42. Generally polyhedral construction elements of claim 17 further limited to construction elements wherein at least one of said polyhedral members is a continuum of facially adjacent facet-based pyramidal members, and wherein no two facially adjacent pyramidal members of said continuum of facially adjacent facet-based pyramidal members have coplanar bases.

43. Generally polyhedral construction elements of claim 42 wherein the apexes of all said facet-based pyramidal members are coincident.

44. The construction elements cited in claim 1 wherein at least three of said difurcated edge sets are mutually perpendicular edge sets.

45. The construction elements cited in claim 17 wherein at least three of said difurcated edge sets are mutually perpendicular edge-terminating edge sets, where said edge-terminating edge sets are inclusive of vertex-terminating edge sets.

46. The construction elements cited in claim 1 wherein each of at least three of said difurcated edge sets is noncoplanar with and nonparallel to the shared plane of at least one co-planar pair of said difurcated edge sets; whereby at least three second construction elements having substantially complementarily formed and difurcated edge sets may be simultaneously interfitted with a first said construction element; thereby enabling the formation of nonplanar generally polyhedral/multiplanar assemblies of said construction elements;

where said at least three second construction elements need not be three identical construction elements.

47. The construction elements cited in claim 17 wherein each of at least three of said difurcated edge sets is obliquely noncoplanar with and nonparallel to the shared plane of at least one co-planar pair of said difurcated edge sets; whereby at least three second construction elements having substantially complementarily formed and difurcated edge sets may be simultaneously interfitted with a first said construction element; thereby enabling the formation of nonplanar generally polyhedral/multiplanar assemblies of said construction elements; where said at least three second construction elements need not be three identical construction elements.

48. The construction elements cited in claim 1 comprising a non-collinear plurality of said difurcated edge sets; whereby a plurality of said construction elements having substantially complementarily formed and difurcated edge sets may be assembled into planar arrays.

49. The construction elements cited in claim 17 comprising a non-collinear plurality of said difurcated edge sets; whereby a plurality of said construction elements having substantially complementarily formed and difurcated edge sets may be assembled into planar arrays.

50. The construction elements of claim 1 further limited to generally cubic construction elements comprising a least one vertex-terminating difurcated edge set, where said edge set comprises the coincident edges of three diagonally adjacent semi- facet-based pyramidal members and three diagonally adjacent semi-facet-based pyramidal recesses.

51. The construction elements of claim 1 further limited to rhombic-dodecahedron-based construction elements comprising a plurality of vertex-terminating difurcated edge sets, where a plurality of said edge sets each comprise the coincident edges of two diagonally adjacent half-facet-based pyramidal members and two diagonally adjacent half-facet-based pyramidal recesses, and where at least one of said edge sets comprises the coincident edges of three diagonally adjacent half-facet-based pyramidal members and three diagonally adjacent half-facet-based pyramidal recesses.

52. Construction elements of claim 17 comprising six interfitted construction elements assembled in the general form of a hexagon, where each of said interfitted construction elements is individually a construction element as defined in claim 17, and where at least one of said difurcated edge sets remains available for interfitting with at least a second construction element of claim 17 having a substantially complementarily formed and difurcated edge set.

53. Construction elements of claim 17 comprising twenty-four interfitted construction elements assembled in a generally geodic form, wherein each of said interfitted construction elements is individually a construction element as defined in claim 17, and where at least one of said difurcated edge sets remains available for interfitting with at least a second construction element of claim 17 having a substantially complementarily formed and difurcated edge set.

* * * * *